US008482401B2

(12) United States Patent
Morino et al.

(10) Patent No.: US 8,482,401 B2
(45) Date of Patent: Jul. 9, 2013

(54) SAFETY BELT AND SYSTEM FOR CHECKING A USAGE STATUS OF THE SAFETY BELT

(75) Inventors: Osamu Morino, Kato (JP); Akitomo Kozuki, Kato (JP); Michihiro Murata, Shimogyo-ku (JP)

(73) Assignees: Techno Links International, Inc., Kyoto (JP); Fujii Denko Co., Ltd., Hyogo (JP)

( * ) Notice: Subject to any disclaimer, the term of this patent is extended or adjusted under 35 U.S.C. 154(b) by 476 days.

(21) Appl. No.: 12/907,083

(22) Filed: Oct. 19, 2010

(65) Prior Publication Data

US 2011/0090079 A1 Apr. 21, 2011

(30) Foreign Application Priority Data

Oct. 20, 2009 (JP) ..... 2009-241795
Jul. 16, 2010 (JP) ..... 2010-162269

(51) Int. Cl.
*G08B 1/00* (2006.01)

(52) U.S. Cl.
USPC ..... 340/532; 340/665; 340/666; 73/862.381

(58) Field of Classification Search
USPC ..... 340/686.1, 532, 665, 666; 73/862.39, 73/862.381
See application file for complete search history.

(56) References Cited

U.S. PATENT DOCUMENTS

| | | | | |
|---|---|---|---|---|
| 3,748,639 | A * | 7/1973 | Dobedoe et al. | 340/457.1 |
| 4,991,682 | A * | 2/1991 | Kuntz et al. | 180/282 |
| 7,752,925 | B2 * | 7/2010 | Koors et al. | 73/862.391 |
| 2003/0150283 | A1 * | 8/2003 | Stanley et al. | 73/862.391 |
| 2009/0173578 | A1 * | 7/2009 | Renton et al. | 182/235 |
| 2013/0068561 | A1 * | 3/2013 | Harris, Jr. | 182/231 |

FOREIGN PATENT DOCUMENTS

| | | |
|---|---|---|
| JP | 11-267237 A | 10/1999 |
| JP | 2007-44166 A | 2/2007 |

* cited by examiner

*Primary Examiner* — Daryl Pope
(74) *Attorney, Agent, or Firm* — Keating & Bennett, LLP

(57) ABSTRACT

A safety belt includes a connecting member including a rope, an attaching portion connected to a first end of the rope and arranged to be attached to a body belt worn around a body of a worker, a hook connected to a second end of the rope, and a load detection portion arranged to detect whether or not a load is applied to the connecting member and to output a load detection signal. The safety belt also includes a control device that includes a receiver unit arranged to receive the load detection signal, a control unit arranged to determine a status of the worker or a status of the safety belt based on the load detection signal, and a notification unit arranged to provide a notification in accordance with control by the control unit corresponding to the determined status.

18 Claims, 23 Drawing Sheets

| № | Status | Hook A | | | Hook B | | | Hook Hanger (Detected number) | Display message | Color | Buzzer | Note |
|---|---|---|---|---|---|---|---|---|---|---|---|---|
| | | Attached | | Safety Device | Attached | | Safety Device | | | | | |
| | | Load (small) | Load (large) | | Load (small) | Load (large) | | | | | | |
| 1 | Hooks A and B are accommodated | – | – | – | – | – | – | 2 | Ready and Waiting | Light Up: Blue | No | |
| 2 | Hook A is removed from hook hanger (or holding object) | × | × | Open | O | × | Close | 1 | Hook A Disattached | Light Up: Red | Intermittent | Hook B is accommodated in hook hanger. |
| 3 | Hook B is removed from hook hanger (or holding object) | O | × | Close | × | × | Open | 1 | Hook B Disattached | Light Up: Red | Intermittent | Hook A is accommodated in hook hanger. |
| 4 | Hooks A and B are removed from hook hangers (or holding object) | × | × | Close | × | × | Close | 0 | Hooks A and B Disattached | Light Up: Red | Intermittent | |
| 5 | Hook A is attached to holding object | O | × | Close | O | × | Close | 1 | Normal Work | Light Up: Blue | No | Hook B is accommodated in hook hanger. |
| 6 | Safety device is pushed for removing hook A from holding object | – | × | Open | O | × | Close | 1 | No Safety Wire Warning | Flicker: Yellow | Intermittent | Hook B is accommodated in hook hanger. |
| 7 | Hook B is removed from hook hanger (or holding object) while hook A is attached to holding object | O | × | Close | × | × | Open | 0 | Hook Change | Light Up: Blue | No | |
| 8 | Hooks A and B are attached to holding object | O | × | Close | O | × | Close | 0 | Hook Change | Light Up: Blue | No | |
| 9 | Hook A is removed from hook hanger (or holding object) while hook B is attached to holding object | × | × | Open | O | × | Close | 0 | Hook Change | Light Up: Blue | No | |

FIG. 9A

| № | Status | Hook A | | | Hook B | | | Hook Hanger (Detected number) | Display message | Color | Buzzer | Note |
|---|---|---|---|---|---|---|---|---|---|---|---|---|
| | | Attached | | Safety Device | Attached | | Safety Device | | | | | |
| | | Load (small) | Load (large) | | Load (small) | Load (large) | | | | | | |
| 10 | Hook B is attached to holding object | ○ | × | Close | ○ | × | Close | 1 | Normal Work | Light Up: Blue | No | Hook A is accommodated in hook hanger. |
| 11 | Safety device is pushed for removing hook B from holding object | ○ | × | Close | - | × | Close | 1 | No Safety Wire Warning | Light Up: Yellow | Intermittent | Hook A is accommodated in hook hanger. |
| 12 | Large load is applied to hook A for 3 seconds | × | ○ | Close | | × | Close | | Fall | Flicker: Red | Continuous | Hook B is accommodated in hook hanger or free. |
| 13 | Large load is applied to hook B for 3 seconds | - | × | Close | × | ○ | Close | - | Fall | Flicker: Red | Continuous | Hook A is accommodated in hook hanger or free. |
| 14 | Large load is applied to hooks A and B for 3 seconds | × | ○ | Close | × | ○ | Close | 0 | Fall | Flicker: Red | Continuous | |

FIG. 9B

SAFETY BELT AND SYSTEM FOR CHECKING A USAGE STATUS OF THE SAFETY BELT

BACKGROUND OF THE INVENTION

1. Field of the Invention

The present invention relates to a safety belt preferably used for a worker in high places, for example, and a system for checking a usage status of the safety belt.

2. Description of the Related Art

Workers in high places like construction sites are required to wear safety belts for the purpose of preventing a fall. A typical safety belt includes a body belt worn around the worker's body; a rope-like connecting member with one end connected to the body belt, called a safety tether or lanyard; and a hook connected to the other end of the connecting member. The worker wears the body belt around the body and attaches the hook to a lifeline, ladder or the like in the construction site to ensure safety while working.

There are two known types of safety belts. The first type is a waist-belt type to be worn around the worker's waist and the second type is a full-body harness type which can hold the full body of the worker with the waist belt and belts worn around the shoulders and thighs.

In order to reliably prevent fall accidents, it is necessary for the worker to properly use the safety belt. Therefore, various systems have been proposed. One system detects the status of the hook attached to the lifeline or ladder and provides a warning if the hook is not properly attached (see JP 11-267237 (A), for example). Another system checks if clothing of the worker or the like is caught in the hook (see JP 200744166 (A), for example).

SUMMARY OF THE INVENTION

As described above, various systems have been proposed for checking the attaching condition of the hook of the safety belt. Therefore, if the worker wears and uses the safety belt properly, it is possible to prevent the worker from falling to the ground. However, even in this case, it is impossible to perfectly prevent the worker from being suspended or taking a misstep to almost fall from the high place due to carelessness. Those cases are also accidents to be prevented. Thus, it is necessary to detect an application of a large load, e.g., around the same load as that applied by a fall of the worker, while the hook is attached, and to make it possible to rescue the worker promptly.

Accordingly, preferred embodiments of the present invention provide a safety device and a system for checking a usage status of the safety belt which can solve the aforementioned problems.

According to a preferred embodiment of the present invention, a safety belt includes a connecting member and a control device. The connecting member includes a rope, an attaching portion connected to a first end of the rope and arranged to be attached to a body belt worn around a body of a worker, a hook connected to a second end of the rope, and a load detection portion arranged to detect whether or not a load is applied to the connecting member and to output a load detection signal. The control device includes a receiver unit arranged to receive the load detection signal, a control unit arranged to determine a status of the worker or a status of the safety belt based on the load detection signal, and a notification unit arranged to provide a notification in accordance with control by the control unit corresponding to the determined status.

When application of a load exceeding a predetermined value to the connecting member is directly or indirectly detected from the load detection signal from the load detection portion, the worker may fall from a high place and be suspended in or by the safety belt, for example. Therefore, in this case, by controlling the notification unit to provide a notification, i.e., warning, it is possible for other people near the worker to rescue the worker promptly. As the load detection portion, various sensors can be used. For example, a pressure-sensitive sensor using pressure sensitive rubber and the like, a strain gauge, sensors which can measure a load or pressure as a numerical value, and sensors which can indirectly detect application of a load exceeding an acceptable load value such as a disconnection sensor can be used.

It is preferable that the hook of the connecting member includes a hook-shaped member, a latch arranged to be opened and closed with respect to an opening of the hook-shaped member, and a transmitter unit arranged to transmit the load detection signal; the load detection portion preferably is a pressure sensor provided at a portion of the hook-shaped portion which comes into contact with a holding object when the hook is attached to the holding object.

It is preferable that the control unit controls the notification unit to provide a warning as the notification when detecting a load or a pressure exceeding a predetermined value for a time period longer than a predetermined time period from the load detection signal.

When a load or pressure exceeding the predetermined value is detected for a time period longer than a predetermined time period from the load detection signal from the pressure sensor which is arranged at a portion of the hook-shaped portion which comes into contact with the holding object when the hook is attached to the holding portion, the worker may fall from a high place and be suspended in or by the safety belt, for example. Therefore, in this case, by controlling the notification unit to provide a warning, it is possible for other people near the worker to rescue the worker quickly. As the load detection portion, various sensors can be used which can detect a load or pressure, such as a pressure-sensitive sensor using pressure sensitive rubber and the like, and a strain gauge.

It is preferable that the hook of the connecting member further includes an open/close sensor arranged to detect whether the latch is opened or closed and to output an open/close detection signal; and the control unit controls the notification unit to provide the notification that the connecting member is attached to the holding object, when the control unit detects that the latch is opened and closed from the open/close detection signal and detects that a load or a pressure which is equal to or smaller than the predetermined value from the load detection of the pressure sensor. In this arrangement, it is possible to surely detect that the connecting member is attached to the holding object based on the combination of the open/close detection signal from the open/close detection sensor and the load detection signal from the pressure sensor. Also, it is possible to notify the worker or someone near the worker of the detection result.

It is preferable that the hook of the connecting member further includes an accommodation sensor arranged to detect that the hook is accommodated in a predetermined accommodating portion of the safety belt and to output an hook-accommodation detection signal, and the control unit controls the notification unit to provide the notification that the hook is out of the accommodation portion, when the control unit is unable to detect that the hook is accommodated in the accommodating portion from the hook-accommodation detection signal, and determines that the connecting member is unattached to the holding object. In this arrangement, in a case where the connecting member is not attached to the holding object after the hook is removed from the accommodation portion, it is possible to determine that the hook is out of the holding object and to notify the worker or someone near the worker of the detected result.

It is preferable that, when the control unit detects that the latch is opened and closed from the open/close sensor while the connecting member is attached to the holding object, the control unit controls the notification unit to provide the notification that the connecting member is going to be detached from the holding object.

It is preferable that the safety device includes two connecting members, and, when the control unit determines that only one of the two connecting members is attached to the holding object, the control unit controls the notification unit to provide the notification that hook change is underway. In this arrangement, in a case where the worker uses two connecting members, it is possible to correctly detect that the hook to be attached to the holding is changed to the other and to notify the detection result.

It is preferable that the notification unit includes a light-emitting portion arranged to emit light, and provides the notification using light. It is also preferable that the notification unit includes an audio output portion arranged to provide an audio output as the notification.

It is preferable that the notification unit includes a transmitter unit arranged to wirelessly transmit the status of the worker or the status of the safety belt determined by the control unit, to a remote device far away from the worker.

It is preferable that the load detection portion is a disconnection sensor which is provided in a base portion of the hook or mounted in the connecting member.

It is preferable that the connecting member further includes a shock absorber having a lead wire therein, and the disconnection sensor is arranged to detect disconnection of the lead wire.

According to another preferred embodiment of the present invention, a system for checking a usage status of the aforementioned safety belt includes a checking device arranged to wirelessly communicate with the control device of the safety belt. The control device of the safety belt further includes a transmitter unit arranged to transmit to the checking device information on the status of the worker or the status of the safety belt determined by the control unit. The checking device includes a monitor screen display unit arranged to display the status of the worker or the status of the safety belt based on the information received from the transmitter unit of the control unit.

According to another preferred embodiment of the present invention, a system for checking a usage status of a safety belt is provided. The safety belt includes a connecting member and a control device. The connecting member includes a rope, an attaching portion connected to a first end of the rope and arranged to be attached to a body belt worn around a body of a worker, a hook connected to a second end of the rope, and a load detection portion arranged to detect whether or not a load is applied thereto. The control device includes a receiver unit arranged to receive the load detection signal, a control unit arranged to determine a status of the worker or the safety belt from the load detection signal, a notification unit arranged to provide a notification in accordance with control by the control unit corresponding to the determined status of the worker or the safety belt, and a transmitter unit arranged to transmit information on the determined status. The system includes a checking device arranged to wirelessly communicate with the control device of the safety belt, wherein the checking device includes a monitor screen display unit arranged to display the status of the worker or the status of the safety belt based on the information received from the transmitter unit of the control unit.

It is preferable that the hook of the connecting member of the safety belt includes a hook-shaped member, a latch arranged to be opened and closed with respect to an opening of the hook-shaped member, and a transmitter unit arranged to transmit the load detection signal of the load detection portion; and the load detection portion of the connecting member of the safety belt preferably is a pressure sensor arranged at a portion of the hook-shaped portion which comes into contact with a holding object when the hook is attached to the holding object.

It is preferable that the checking device further includes a history screen display unit arranged to display a history of the status of the worker or the status of the safety belt based on the information received from the transmitter of the control device.

The above and other elements, features, steps, characteristics and advantages of the present invention will become more apparent from the following detailed description of the preferred embodiments with reference to the attached drawings.

BRIEF DESCRIPTION OF THE DRAWINGS

FIGS. 9A and 9B show patterns of the usage status of the connecting member in the first preferred embodiment of the present invention.

DETAILED DESCRIPTION OF THE PREFERRED EMBODIMENTS

Referring to FIGS. 1 through 22, preferred embodiments of the present invention are described.

First Preferred Embodiment

1-1. Configuration of a Full-Body Harness Type Safety Belt

Figure 1:
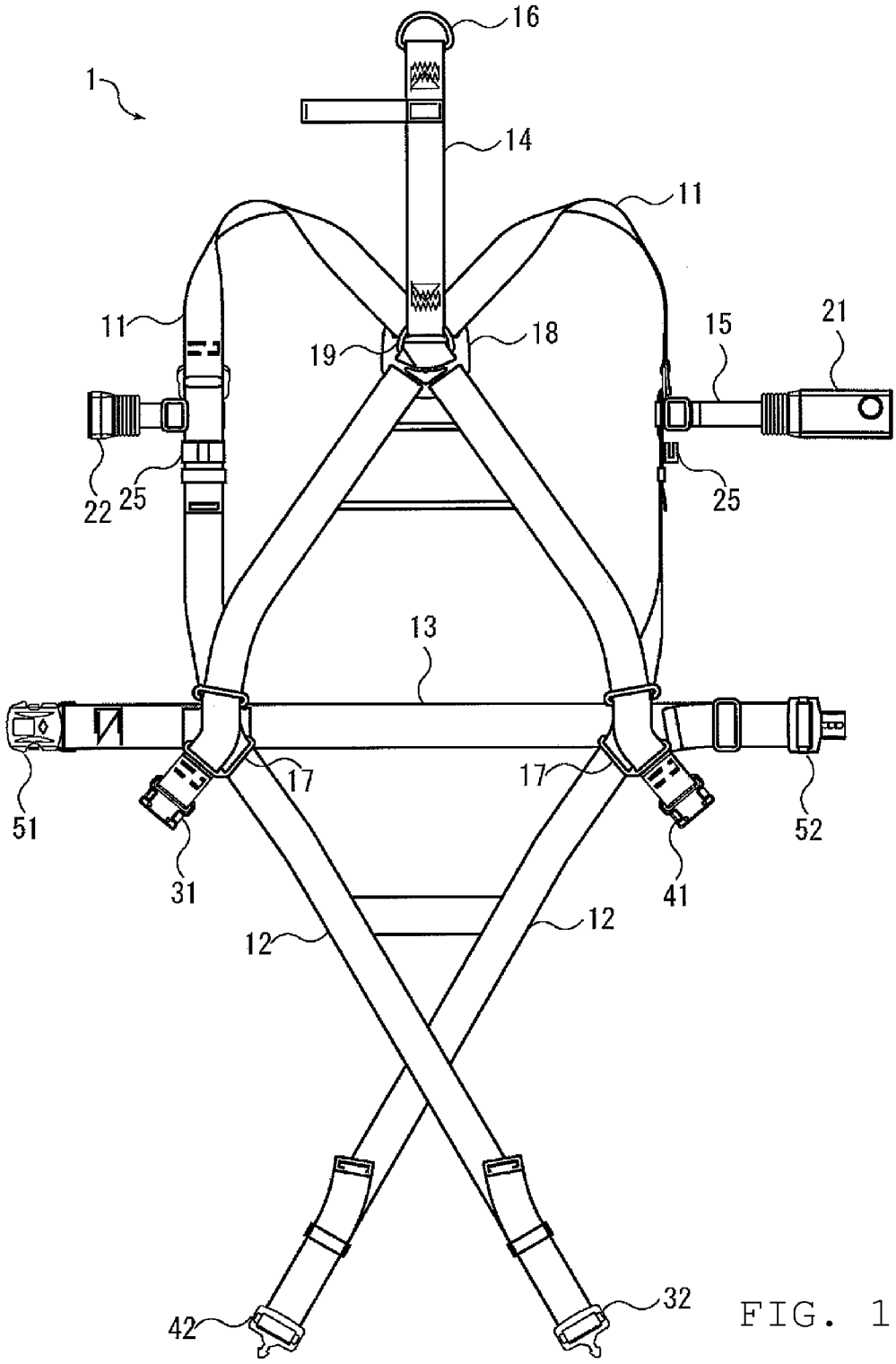
FIG. 1 shows a full-body harness type safety belt according to the first preferred embodiment of the present invention.

FIG. 1 shows an unworn configuration of a safety belt 1 in the first preferred embodiment of the present invention. The safety belt 1 is a full-body harness type and includes a pair of shoulder belts 11, 11, a pair of thigh belts 12, 12, and a waist belt 13.

The shoulder belts 11, 11, i.e., right and left belts are arranged to be worn around the upper body of a worker such that the shoulder belts 11, 11 cross each other on the back of the worker, go over the right and left shoulders to reach the chest. The shoulder belts 11, 11 further extend from the chest to the waist, and one ends of the shoulder belts 11, 11 are inserted into right and left connectors 17, 17 arranged on the right and left side of the waist, respectively. Below the connectors 17, 17, the shoulder belts 11, 11 continue to the thigh belts 12, 12.

Also, on the back of the body, the shoulder belts 11, 11 are arranged to extend from the intersection to the right and left sides of the waist where other ends of the shoulder belts 11, 11 are inserted into the connectors 17, 17. Below the connectors 17, 17, the first buckle 31 and the second buckle 41 are coupled to the shoulder belts 11, 11.

The right and left thigh belts 12, 12 are worn around the lower body of the worker such that they extend on the back from the connectors 17, 17 on the waist into the crotch, intersect with each other at the crotch, and then run upwards to reach the waist again. The thigh belts 12, 12 are provided with the first insertion tongue 32 and the second insertion tongue 42 connected thereto.

The waist belt 13 is also inserted into the right and left connectors 17, 17. The waist belt 13 is provided with the third buckle 51 connected thereto at one end and the third insertion tongue 52 connected thereto at the other end.

FIG. 1 shows the safety belt 1 in the unworn configuration. When the safety belt 1 is worn, the waist belt 13 is worn around the waist and the thigh belts 12, 12 extending downwards in FIG. 1 are bent upwards around the intersection thereof to cover the crotch.

A worker wears the safety belt 1 having the above configuration when working in high places. For example, while wearing the thigh belts 12, 12 on the crotch and putting the shoulder belts 11, 11 over the shoulders, the worker attaches the first buckle 31 to the first insertion tongue 32 and the second buckle 32 to the second insertion tongue 42. Also, the worker attaches the third buckle 51 to the third insertion tongue 52 on the front side of the waist. In this preferred embodiment, one-touch buckles are preferably used as the first, second and third buckles 31, 41 and 51, but slide buckles can be used.

The shoulder belts 11, 11 are inserted into a connector 18 at the intersection on the back. The connector 18 is provided with a ring 19 to which a belt 14 is attached. At the other end of the belt 14, a ring 16 is attached such that a connecting member or lanyard can be attached to the ring 16. To the ring 19, another lanyard can be attached via another belt 14 or directly (without the other belt 14). Alternatively, two lanyards may be directly attached to the ring 19 without the belts 14.

When working in high places, the worker attaches a hook connected to one end of the lanyard to a holding object such as a lifeline, a ladder or a post. In this manner, the worker's safety during working in high places can be ensured. The lanyard and the hook will be described in detail later. Moreover, the full-body harness type safety belt 1 of this preferred embodiment ensures the worker's safety preferably with two lanyards. The two lanyards in this preferred embodiment may be the same as each other in specification. Alternatively, one lanyard may work as a main connecting member, while the other one may work as an auxiliary connecting member which assists the function of the main connecting member. More specifically, the auxiliary connecting member may be shorter than the main connecting member.

Figure 2:
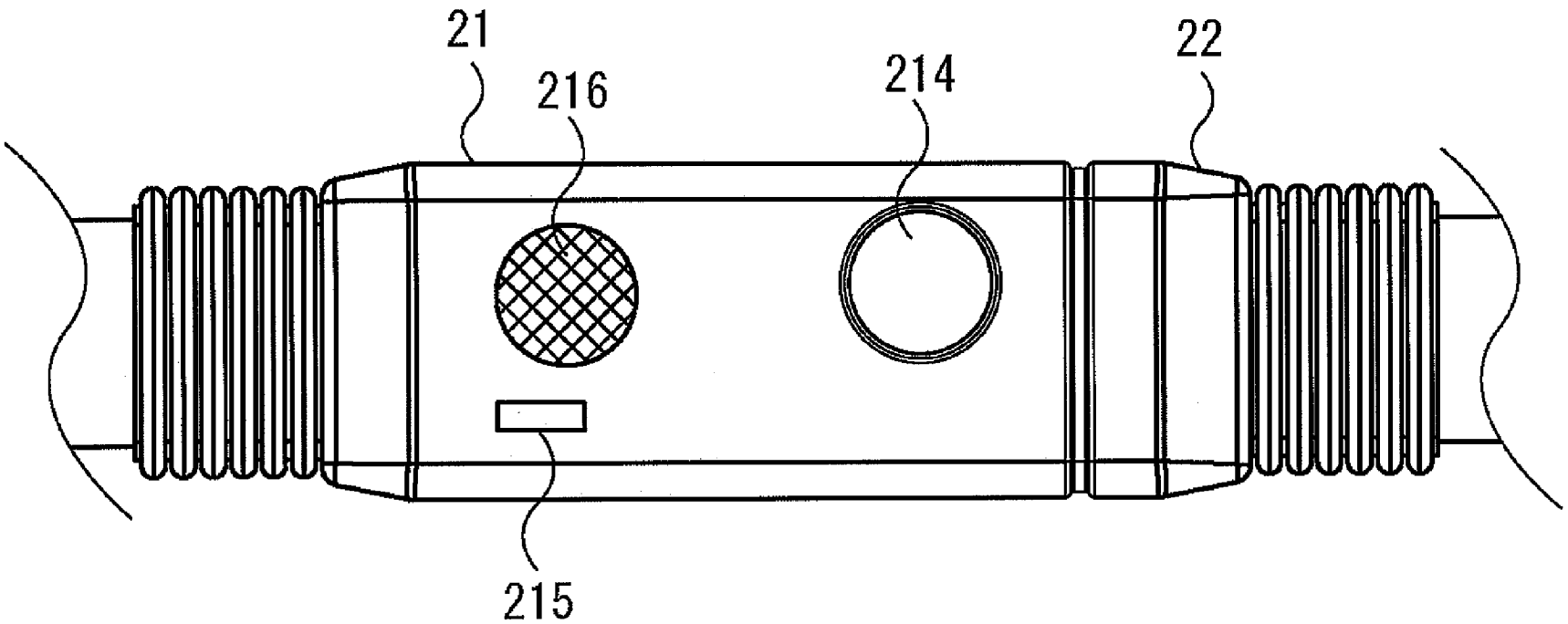
FIG. 2 shows the appearance of a control box in the first preferred embodiment of the present invention.

The safety belt 1 further includes a belt 15 arranged to connect the shoulder belts 11, 11 around the chest. As shown in FIG. 1, the belt 15 is provided with a control box 21 (control device) at one end and a coupling portion 22 at the other end. The control box 21 and the coupling portion 22 can be attached to and detached from each other. The ends of the belt 15 can be coupled to each other by attaching the control box 21 and the coupling portion 22 to each other. As shown in FIG. 2, the control box 21 is provided with a window 214, a switch 215, and a speaker cover 216 on the front surface thereof. The window 214 covers a light source such as an LED, and the speaker cover 216 covers a speaker for beeping, sounding a warning tone, or outputting a warning message in a synthesized voice, for example. The light source and the speaker will be described later.

Figure 3:
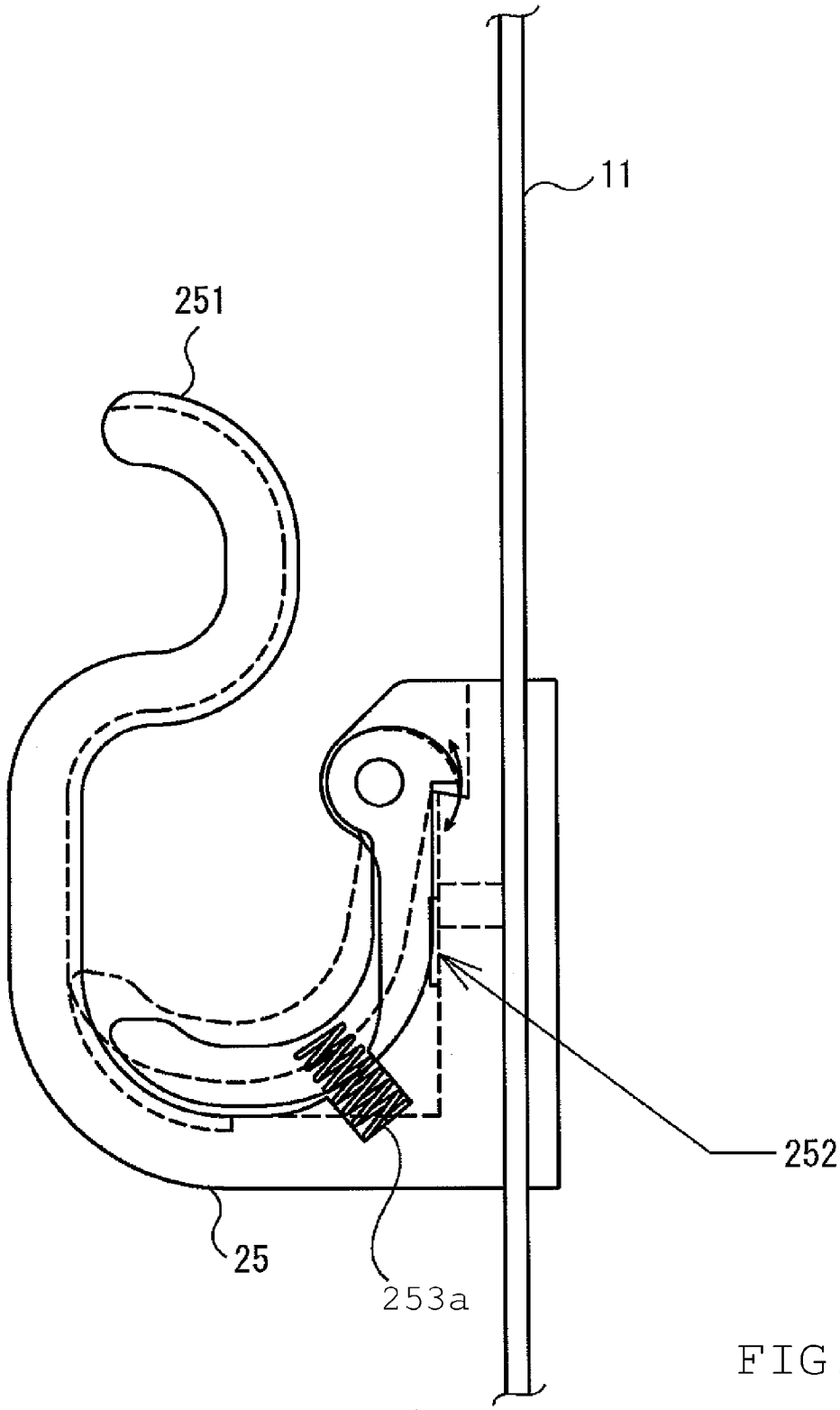
FIG. 3 shows a cross section of a hook hanger in the first preferred embodiment of the present invention.

Returning to FIG. 1, the safety belt 1 is provided with two hook hangers 25, 25 (hook accommodation portions) on the front surface of the shoulder belts 11, 11, respectively. In the hook hangers 25, 25, the hooks of the two lanyards can be accommodated when the safety belt 1 is not used in high places. FIG. 3 shows a cross section of the hook hanger 25. As shown in FIG. 3, the hook hanger 25 has a hook-shaped hook catching portion 251 which can engage with the hook of the lanyard placed thereon. The hook hanger 25 also includes an accommodation sensor arranged to detect that the hook of the lanyard is accommodated in the hook hanger 25. In the example of FIG. 3, this accommodation sensor includes a lever 252 which is pushed by application of a pressure and a switch sensor 253*a* which turns on when the lever 252 is pushed in. The hook hanger 252 further includes a battery (not shown) arranged to supply power to the switch sensor 253*a*. The output of the switch sensor 253*a* is sent to a transmitter/receiver unit 211 in the control box 21 via wireless communication in this preferred embodiment. The manner of transmission will be described later.

In this preferred embodiment, a mechanical sensing arrangement using the lever 252 is described as an example of the sensor arranged to detect that the hook of the lanyard is accommodated in the hook hanger 25. The accommodation sensor is not limited thereto, but any type of sensor can be used. For example, a Hall effect sensor can be used. In the case of using a Hall effect sensor, a magnet is provided in one of the hook of the lanyard and the hook hanger 25, and the Hall effect sensor is provided in the other. This arrangement makes it possible to detect that the hook is accommodated in the hook hanger 25. Moreover, a switch sensor can be used as the accommodation sensor.

Alternatively, an IC tag system may be used. In this case, an IC tag including an antenna and an IC chip therein is attached to the hook hanger 25 while a transmitter arranged to transmit a signal to the IC chip and a receiver arranged to receive a signal from the IC chip is provided in the hook, for example. When the hook is accommodated in the hook hanger 25, the IC chip on the hook hanger 25 receives a signal from the hook and the receiver on the hook receives a response from the IC chip. In this manner, it can be determined whether the hook is accommodated in the hook hanger 25 or not. Moreover, the use of the IC tag system also makes it possible to determine whether the hook is accommodated in the correct one of the hook hangers 25 or the wrong one. Alternatively, the transmitter/receiver may be provided on the hook hanger 25, while the IC tag may be attached to the hook.

Furthermore, the arrangement is possible in which the hook hanger 25 is provided to the control box 21, the IC chip is provided to the hook, and the transmitter/receiver is provided in the control box 21. In this arrangement, the transmitter/receiver can use the power supply in the control box 21 and therefore the life of the battery in the hook can be made longer.

1-2. Configurations of Lanyard and Hook

Figure 4:
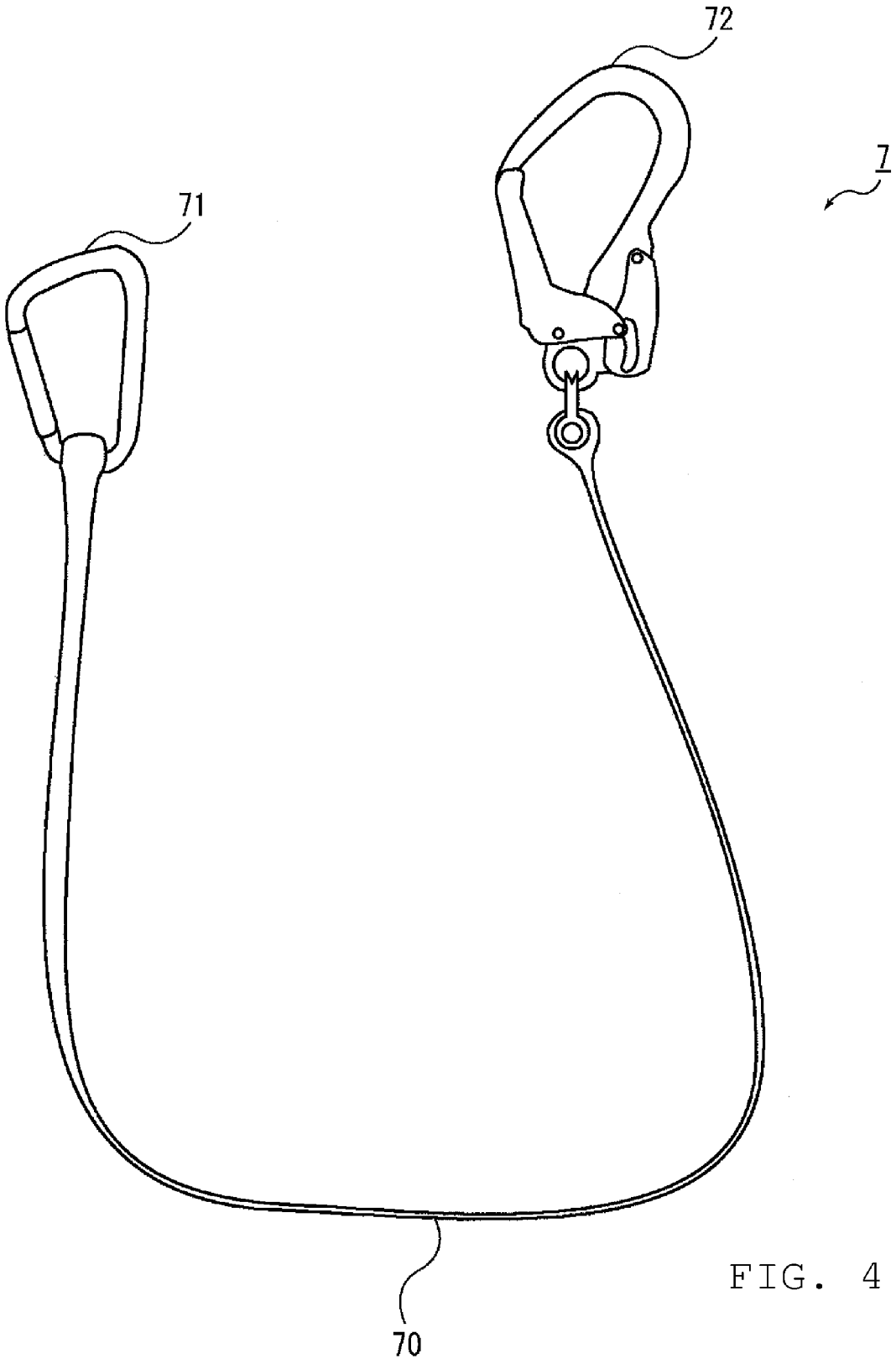
FIG. 4 shows the appearance of a connecting member in the first preferred embodiment of the present invention.

Referring to FIG. 4, the configuration of the lanyard is described. As shown in FIG. 4, the lanyard 7 includes a rope 70, a carbine hook 71 connected to one end of the rope 70, and a hook 72 connected to the other end of the rope 70. The lanyard 7 can have any length. The rope 70 is not limited to fiber rope, but can be formed by any member in the form of belt, cord or rope having required strength. Although not shown in FIG. 4, it is preferable to arrange a shock absorber at any portion of the rope 70 of the lanyard 7 or at the connection between the rope 70 and the carbine hook 71 or the hook 72, so as to absorb shock which will be applied to the rope 70 when the worker wearing the safety belt 1 falls, for example.

Figure 5:
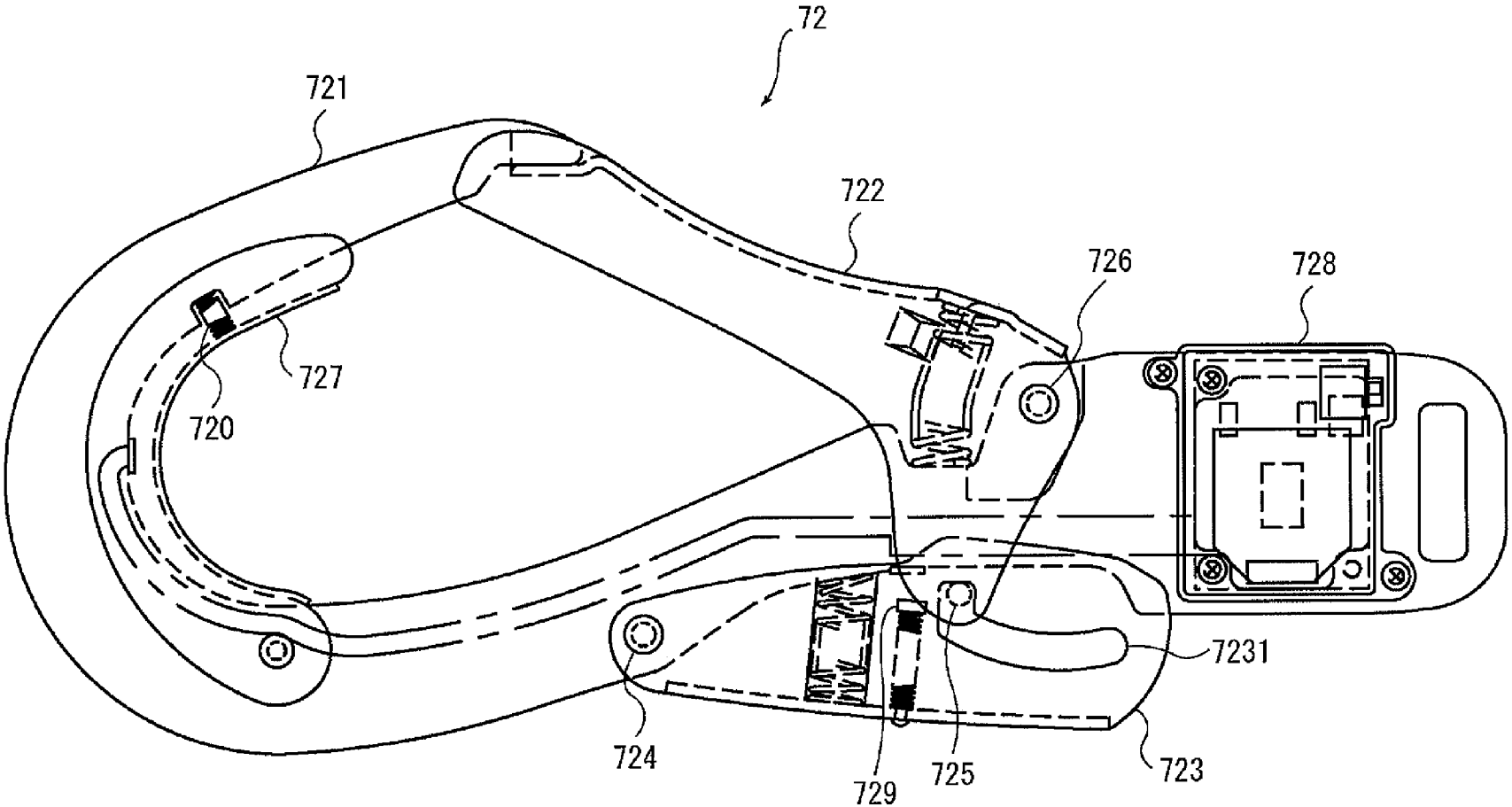
FIGS. 5, 6, and 7 show a hook of the connecting member in the first preferred embodiment of the present invention.

Referring to FIG. 5, the hook 72 includes a hook-shaped member 721, a latch 722, and a safety device 723. The latch 722 is arranged to be pivotally movable around a rivet 726 defining an axis. The safety device 723 has a slide groove 7231 and is arranged to be pivotally movable around a rivet 724 as an axis. In the slide groove 7231, a rivet 725 attached to the latch 722 is located. The slide groove 7231 has a curved shape such that the rivet 725 slides in the slide groove 7231 when the worker grasps the safety device 723 and further slides when the worker grasps the latch 722 while grasping the safety device 723. That is, the shape of the slide groove 7231 is designed such that the latch 722 cannot be opened/closed even when an external force is applied to the latch 722 while the safety device 723 is not grasped.

The hook 72 also includes an open/close sensor 729 which can detect whether the latch 722 is opened or closed, a lever-shaped member 727 which is arranged to be pushed in when the hook 72 is attached to a holding object such as a lifeline, a pressure sensor 720 which is arranged to, when the lever-shaped member 727 is pushed in, turn on and detect a load or pressure applied to the hook 72 from the holding object, and a circuit board 728. The circuit board 728 is provided with various circuits arranged to process the signals output from the open/close sensor 729 and the pressure sensor 720 and to control operations including signal transmission to a central device (described later). To the circuit board 728, a battery (not shown) is connected. The battery also supplies a power to the sensors of the hook 72 if needed. Turning on and off the battery can be controlled manually, for example, by switching on and off a power switch (not shown) by the worker.

Figure 6:
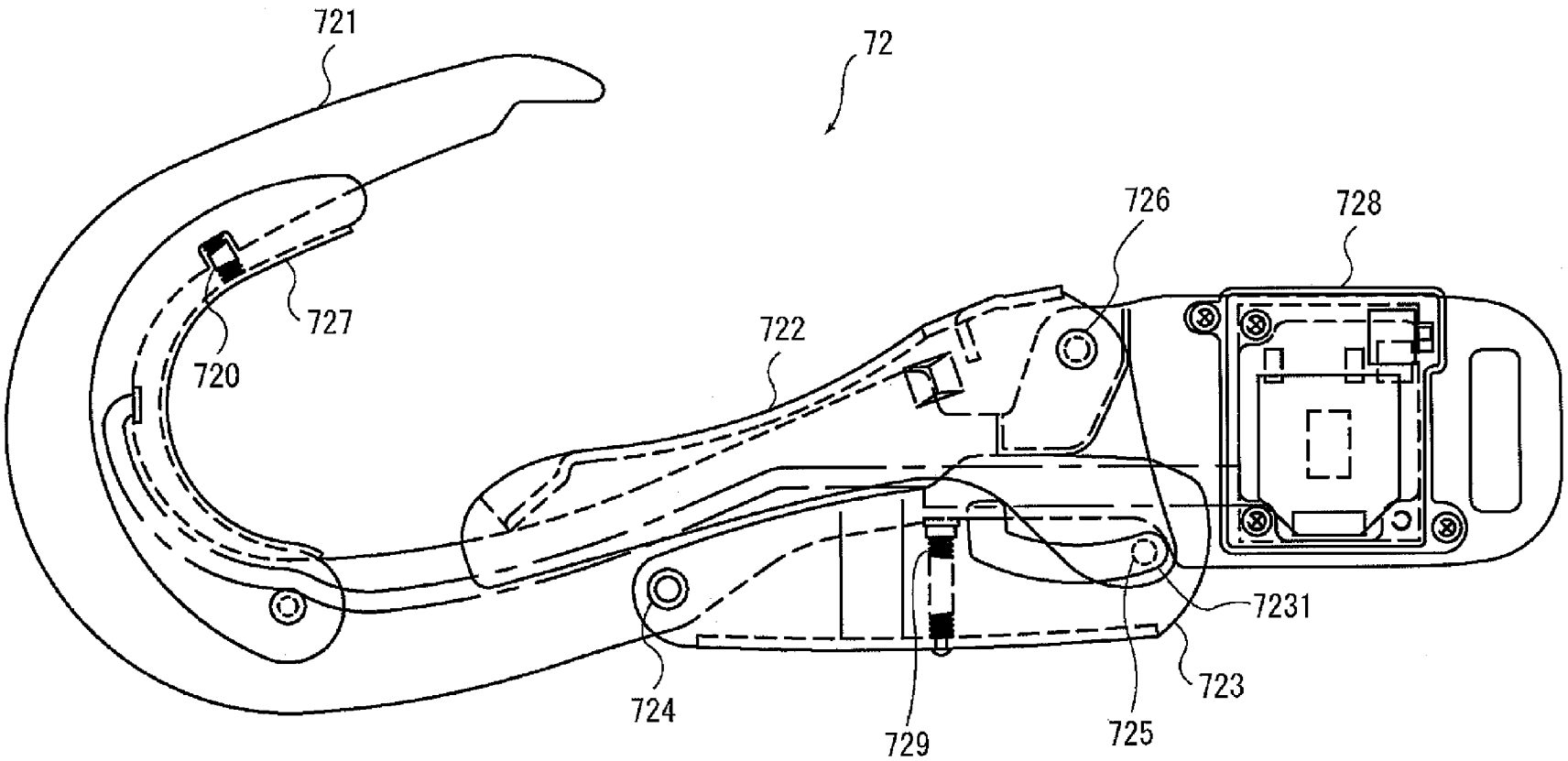

Referring to FIGS. 5 and 6, movement of the hook 72 is described. FIG. 5 shows the hook 72 in resting state. In FIG. 5, the safety device 723 of the hook 72 is locked and the latch 722 is closed with respect to the hook-shaped member 721 (i.e., closed state). In this state, when the worker grasps a lower portion of the safety device 723 of the hook 72, the safety device 723 pivotally moves around the rivet 724 in counter clockwise direction in FIG. 5. The safety device 723 after being pivotally moved in the counter clockwise direction is shown in FIG. 6. Thus, the rivet 725 slides in the slide groove 7231 approximately downward in FIGS. 5 and 6, and the safety device 723 is unlocked or released. Then, the worker grasps the latch 722 while grasping the safety device 723, the latch 722 pivotally moves around the rivet 726 as an axis in counter clockwise direction in FIG. 6, and the rivet 725 slides in the slide groove 7231 approximately horizontally in FIG. 6. Thus, the latch 722 is opened with respect to the hook-shaped member 721 (i.e., opened state), as shown in FIG. 6. That is, in the hook 72, the curved shape of the slide groove 7231 is designed such that the latch 722 cannot be pivotally moved, before the worker grasps to unlock the safety device 723 before grasping the latch 722. Therefore, unintentional opening of the latch 722 of the hook 72 can be prevented, thus preventing the hook 72 from being detached from the holding object. When the safety device 723 is unlocked, the open/close sensor 729 provided in the safety device 723 outputs a signal indicating that the latch 722 is opened.

In this preferred embodiment, based on the state of the safety device 723, i.e., the locked state or the unlocked state, it is detected whether the latch 722 is opened or closed. However, the arrangement to detect the status of the latch 722 is not limited to the above. For example, a sensor may be used which can directly detect the status of the latch 722. Moreover, as the open/close sensor 729, any type of sensor, e.g., a mechanical sensor, a pressure sensor, or a switch sensor can be used.

Figure 7:
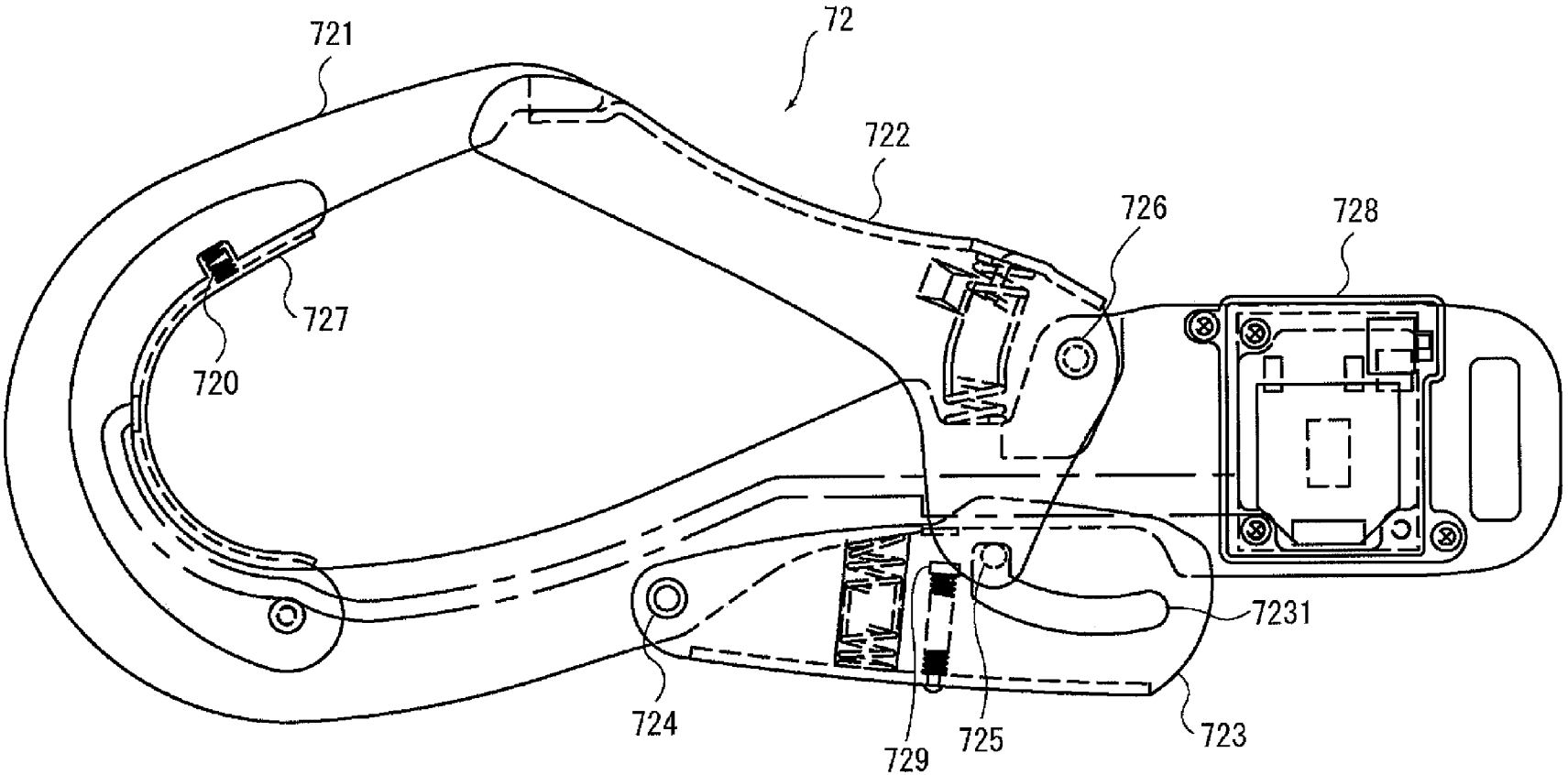

Next, the detection by the pressure sensor 720 is described referring to FIGS. 5 and 7. As described above, the hook 72 is provided with the lever-shaped member 727 at a position of the hook-shaped member 721 where, when the hook 72 is attached to a holding object such as a lifeline or a ladder, the holding object and the hook-shaped member 721 are brought into contact with each other. The lever-shaped member 727 slightly projects from the inner periphery of the hook-shaped member 721 when the hook 72 is not placed on the holding object, as shown in FIG. 5. When the hook 72 is attached to the holding object, the lever-shaped member 727 is pressed toward the outer periphery of the hook-shaped member 721 by stress applied by the holding object, as shown in FIG. 7. Please note that the "inner periphery of the hook-shaped member 721" is the side of the hook-shaped member 721 on which the lever-shaped member 727 is provided, while the "outer periphery of the hook-shaped member 721" is the periphery on the other side. In this preferred embodiment, the pressure sensor 720 detects the magnitude of the applied load when the hook-shaped member 721 is pressed in the above-described manner. The pressure sensor 720 can be implemented by any type of sensor, e.g., a load meter or a strain gauge, as long as it can detect the magnitude of a load or a pressure.

1-3. Configuration and Operation of a Checking System

Figure 8:
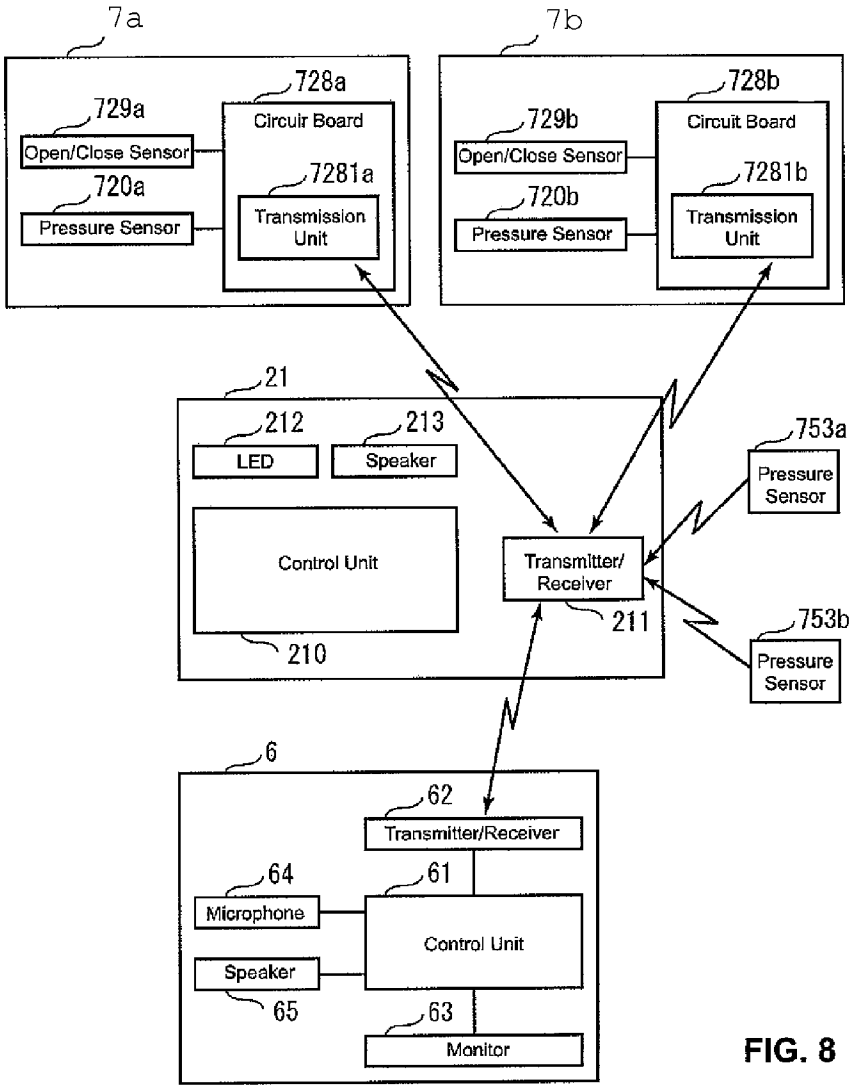
FIG. 8 is a block diagram of a status checking system according to the first preferred embodiment of the present invention.

The configuration of a system for checking whether or not the above-described full-harness type safety belt 1 and the lanyard 7 are properly used is now described. Hereinafter, the system is simply referred to as the checking system. FIG. 8 shows the system configuration of the checking system. The checking system includes the full-harness type safety belt 1, two lanyards 7, and a personal computer (hereinafter, referred to as PC) 6 as a central device. In the following description, one of the two lanyards 7 which is used as a main lanyard is labeled with "7*a*" and the other one used as an auxiliary lanyard is labeled with "7*b*". Also, the components of the lanyards 7*a* and 7*b* are labeled in the similar manner. For example, the hook of the lanyard 7*a* is labeled with "72*a*" and the hook of the lanyard 7*b* is labeled with "72*b*".

The PC 6 is placed in a control room or the like. In a construction site, for example, the PC 6 is placed in the supervisor's office provided in the construction site. An application program for checking the status of the safety belt is installed in the PC 6. The PC 6 can run an application to check the status of the safety belt by using the application program to checking the status of the safety belt and a driver program such as a wireless LAN driver. That is, the checking system of this preferred embodiment is preferably defined by a commonly-used PC and programs.

As shown in FIG. 8, in the checking system of this preferred embodiment, the hook 72*a* of the lanyard 7*a* is provided with the pressure sensor 720*a*, the open/close sensor 729*a* and the circuit board 728*a* as described above. The circuit board 728*a* is provided with a transmission unit 7281*a* which is arranged to receive the signals respectively output from the pressure sensor 720*a* and the open/close sensor 729*a* and to transmit the received signals wirelessly. The hook 72*b* of the lanyard 7*b* preferably has basically the same structure as that of the hook 72*a* and therefore the redundant description is omitted.

The control box 21 of the safety belt 1 includes a control unit 210, the transmitter/receiver unit 211, a 3-color LED light source 212, and a speaker 213. The transmitter/receiver unit 211 is arranged to receive the output signals of the sensors from the transmission unit 7281*a* of the hook 72*a* and the transmission unit 7281*b* of the hook 72*b* and to send the received signals to the control unit 210. The transmitter/receiver unit 211 is also arranged to receive output signals of the switch sensors 253 (referred to as the switch sensors 253*a* and 253*b*) respectively provided in the hook hangers 25, 25 and to send the received signals to the control unit 210.

The control unit 210 includes a CPU, a RAM and the like and controls the control box 21. The control unit 210 is also arranged to process the output signal of the sensors, send the results of the processing to the PC 6 as the central unit, and provide a warning to the worker with the LED light source 212 and/or the speaker 213. The transmitter/receiver unit 211 wirelessly transmits information on the state of the hooks detected by the control unit 210 and the like to the PC 6.

The LED light source 212 is arranged to emit light in accordance with a light-emitting instruction from the control unit 210. In this preferred embodiment, the LED light source 212 includes RGB LEDs and can emit various colors of light by controlling the turning on and off of the LEDs. More specifically, the LED light source 212 can preferably light up or flash with any of four colors of light, i.e., red, blue, yellow, or white light by turning on the RGB LEDs individually in this preferred embodiment. The colors of light are not limited to four colors, but various colors of light can be emitted by mixing the primary colors. The light emitted from the LED light source 212 passes through the window 214 and reaches the outside. The light functions as the notification. The window 214 is preferably made of material which can scatter the light from the LED light source 212 to make the light more visible, e.g., acrylic resin.

Although not shown in FIG. 8, it is preferable that the control box 21 include a microphone to be used to input the worker's voice and/or a CCD camera which can capture an image. In this case, the transmitter/receiver unit 211 can transmit the sound inputted by the microphone and/or the image captured by the CCD camera to the PC 6, and therefore the situation of the field and the like can be clearly reported from the worker to the supervisor who watches the PC 6 as the central device of the checking system.

The PC 6 includes a control unit 61, a transmitter/receiver unit 62, a monitor 63, a microphone 64, and a speaker 65. The transmitter/receiver unit 62 is arranged to send the control unit 61 the signal transmitted from the transmitter/receiver unit 211 of the control box 21 of the safety belt 1. The control unit 61 processes the signal, displays the processing result on the monitor 63, and provides the worker with an instruction via the microphone 64 and the speaker 65, if needed. Alternatively, the instruction may be provided to the worker with a cell phone or a transceiver, instead of using the microphone 64 and the speaker 65.

Preferably the wireless communications between the transmission units 7281*a* and 7281*b* of the hooks 72*a* and 72*b* and the transmitter/receiver unit 211 of the control box 21 and between the transmitter/receiver unit 211 and the transmitter/receiver unit 62 of the PC 6 can use the wireless networking technologies defined by IEEE 802.11 standards or Bluetooth (registered trademark) technology, for example. However, the wireless communication method which can be applied is not limited to the above, but any communication protocol can be used. Moreover, the communication between the transmission units 7281*a* and 7281*b* of the hooks 72*a* and 72*b* and the transmitter/receiver unit 211 of the control box 21 of the safety belt 1 may be wire communication using at least one appropriate cable.

Next, the operation of the checking system having the above-described configuration is described.

Before starting the work, the worker wears the full-body harness type safety belt 1 on the body and then attaches two lanyards 7*a* and 7*b* to the safety belt 1. At this step, the hooks 72*a* and 72*b* of the lanyards 7*a* and 7*b* are accommodated in the hook hangers 25, of the safety belt 1, respectively. Then, the worker turns on the power switches of the hooks 72*a* and 72*b* to start the power supply to the open/close sensors 729*a* and 729*b*, the pressure sensors 720*a* and 720*b*, and the circuit boards 728*a* and 728*b*. The start of the power supply to the switch sensors 253*a* and 253*b* of the hook hangers 25 may be associated with turning on the power switches of the hooks 72*a* and 72*b* or may be controlled by switches separately provided. After the start of the power supply, the above sensors periodically send their output signals to the transmission units 7281*a* and 7281*b* at a predetermined interval. The transmission units 7281*a* and 7281*b* send the output signals of the sensors to the control unit 211 at a predetermined interval.

The worker is required to attach the hooks 72*a* and 72*b* of the lanyards 7*a* and 7*b* to a holding object such as a lifeline or ladder before reaching a predefined height. It is assumed in this example that the worker attaches the lanyard 7*a* to the holding object. First, the worker has to remove the hook 72*a* from the hook hanger 25. To do this, the worker grasps the safety device 723*a* of the hook 72*a* of the lanyard 7*a* and then grasps the latch 722*a*, thereby opening the latch 722*a* with respect to the hook-shaped member 721*a*. At this time, the open/close sensor 729*a* sends an output signal indicating that the safety device 723*a* is released or unlocked, to the control unit 210 via the transmission unit 7281*a* and the transmitter/receiver unit 211. Thus, the control unit 210 can detect that the latch 722*a* of the hook 72*a* is opened. At the same time, the switch sensor 253*a* is turned off because the hook 72*a* is removed from the hook hanger 25. Thus, the control unit 210 can determine that the hook 72*a* is in an "off-hook state" in which the hook 72*a* is not accommodated in the hook hanger 25. The determination result is displayed with the LED light source 212 and is also sent to the PC 6.

Then, when the worker attaches the hook 72*a* to the holding object and releases the hand from the hook 72*a*, the holding object pushes the lever-shaped member 727*a* provided in the hook-shaped member 721*a* of the hook 72*a*. Also, the weight of the hook 72*a* (e.g., 2N) is applied to the pressure sensor 720*a*, thus varying the detected value of the pressure sensor 720*a*. Therefore, by monitoring the detected value of the pressure sensor 720*a* in the control unit 210, it can be determined whether or not the hook 72*a* is attached to the holding object. In addition, if the hook 72*a* is properly attached to the holding object, when the worker releases the hand from the hook 72*a*, the latch 722*a* is closed with respect to the hook-shaped member 721*a* and the safety device 723 also gets back to the locked state (shown in FIG. 5) from the released state (shown in FIG. 6). Thus, the value of the output signal of the open/close sensor 729*a* changes from a level indicating the opened state of the latch 722*a* to a level of the closed state. At the same time, the detection value of the pressure sensor 720*a* should be changed from a value indicating that no load is applied to a larger value. In this preferred embodiment, in a case where the detected value of the pressure sensor 720*a* remains at the no-load level after a predetermined time period (e.g., 5 seconds) has elapsed after the change of the level of the output signal of the open/close sensor 729*a* from the opened-state level to the closed-state level, the control unit 210 determines that the hook 72*a* is out of the holding object (unattached state). On the other hand, when the detected value of the pressure sensor 720*a* is larger than the non-load value while the output signal of the open/close sensor 720*a* is at the closed-state level, the control unit 210 determines that the hook 72*a* is properly attached to the holding object (attached state). Moreover, when the output signal of the open/close sensor 729*a* is at the opened-state level for a time period longer than a predetermined time period (e.g., 5 seconds), the control unit 210 determines that there is something wrong with the latch 722*a* or the safety device 723*a* of the hook 72*a*.

When it is detected that a load exceeding a predetermined load (e.g., 300N) is applied to the pressure sensor 720*a* for a time period longer than a predetermined time period (e.g., 3 seconds), the control unit 210 determines that the worker fell from the high place such as a scaffold. Moreover, when it is detected that a load (e.g., 300N) exceeding the predetermined load is applied to the pressure sensor 720*a* but the detected value of the pressure sensor 720*a* returns to a value equal to or smaller than the predetermined value within the predetermined time period (e.g., 3 seconds), the control unit 210 determines that the worker fell on the scaffold or the like but did not fall off of the scaffold.

Referring to FIGS. 9A and 9B, patterns which can be detected by the checking system of this preferred embodiment are described. In this preferred embodiment, the checking system can detect the patterns based on combinations of the output signal of the pressure sensor 720 of the hook 72, the output signal of the open/close sensor 729 of the safety device 723, and the output signal of the switch sensor 253 of the hook hanger 25. In this description, a hook A and a hook B are assumed to correspond to the hook 72*a* and the hook 72*b*, respectively.

Regarding the hook A, the column "Attached" shows the magnitude of the load detected by the pressure sensor 720*a*. In the column "Load (small)", cross mark shows that no load is detected, and white circle shows that a load within a predetermined load range (e.g., 2N to 300N) is detected. In the column "Load (large)", cross mark shows that the detected value of the pressure sensor 720*a* is not larger than a predetermined load (e.g., 300N), and white circle shows that the detected value of the pressure sensor 720*a* is larger than the predetermined value. In the column "Safety Device", "Open" shows that the open/close sensor 729 outputs the output signal indicating that the safety device 723 is unlocked or in the released state and the latch 722 is opened. Also, "Close" in the column "Safety Device", the open/close sensor 729 outputs the output signal indicating that the safety device 723 is locked and the latch 722 is closed. The column "Hook Hanger" shows the number of hooks which are detected to be accommodated in the hook hangers 25. That number can be determined by the control unit 210 based on the output signals from the switch sensors 253 of the hook hangers 25. The column "Display Message" shows the message to be displayed on the monitor 63 of the PC 6. The column "Color" shows how the LED light source 212 lights up or flickers. The column "Buzzer" shows how the speaker 213 sounds. In this preferred embodiment, the control unit 210 determines the contents of a notification to be provided in accordance with the patterns shown in FIGS. 9A and 9B.

For example, Pattern No. 1 shown in the uppermost row is described. In this pattern, the number of the hooks accommodated in the hook hangers 25 is detected as 2. Thus, the control unit 210 outputs the message "Ready and Waiting" to the monitor 63 irrespective of the state of the hooks 72. In Patterns Nos. 2 and 3 shown in the second and third rows, in either one of the hooks 72*a* and 72*b*, a load smaller than a predetermined load is applied to the pressure sensor 720 and the latch 722 is opened. This means that the one of the hooks 72*a* and 72*b* is attached to the holding object but the latch 722 and the safety device 723 are not surely closed. Therefore, a warning is provided to the worker by red light from the LED light source 212 and a buzzer sound from the speaker 213.

In Patterns Nos. 12 and 13 shown in the 12th and 13th rows, the pressure sensor of either one of the hooks 72*a* and 72*b* detects that a load exceeding the predetermined load is applied for a time period longer than three seconds. In this case, it is presumed that the worker fell from the high place. Thus, the control unit 210 controls the LED light source 212 to emit red light and controls the speaker 213 to output a buzzer sound, thereby making easier for other people to discover where the worker fell. In addition, the control unit 210 controls the monitor 63 of the PC 6 to display a flashing message indicating that a fall might have occurred, thereby providing early notification to the supervisor watching the monitor 63 of the occurrence of the fall.

In Patterns Nos. 6 and 11 in the 6th and 11th rows, while one of the hooks 72*a* and 72*b* is accommodated in the hook hanger 25 and the other hook is attached to the holding object, it is detected that the safety device of the hook attached to the holding object is pushed. In a normal procedure, before one of the hooks which is attached to the holding object is removed, the other hook has to be attached to the holding object. However, in the case of Patterns Nos. 6 and 11, the worker does not comply with the procedure and, if the hook attached to the holding object is removed, the worker is in a state of "No Safety Wire" in which the safety belt is not attached to the holding object. This state is very dangerous. Thus, when this state is detected, the control unit 210 controls the LED light source 212 to emit yellow light and also controls the speaker 213 to output a buzzer sound. In this manner, warning that the worker may be in the "No Wire State" is provided to the worker. Also, a flashing message indicating that the "No Safety Wire" state may occur may be displayed on the monitor 63 of the PC 6.

As described above, the checking system of this preferred embodiment can detect that a fall might have occurred based on the output signals of the sensors of the hooks, and can provide a warning quickly. Also, even if someone has fallen, it is possible for the supervisor and other workers to take urgent action.

The control box 21 in this preferred embodiment notifies the worker of the state of the hooks by changing the light-emitting manner of the LED light source 212. Alternatively, the control box 21 may provide a notification to the worker with audio messages from the speaker 213. For example, audio messages of "Both of the two hooks are properly attached. You can start work." and "A hook is not properly attached. Please check if hooks are attached." may be output.

1-4. Administrative Screen on PC 6

In the system of this preferred embodiment, the transmitter/receiver unit 211 of the control box 21 sends the result of the status determination by the control unit 210 to the transmitter/receiver unit 62 of the PC 6. In the PC 6, the control unit 61 displays a monitoring screen (see FIG. 10) on the monitor based on the data or information received by the transmitter/receiver unit 62, and records the history of the received data or information. The monitoring screen shows the lanyard attaching status for every worker.

Figure 10:
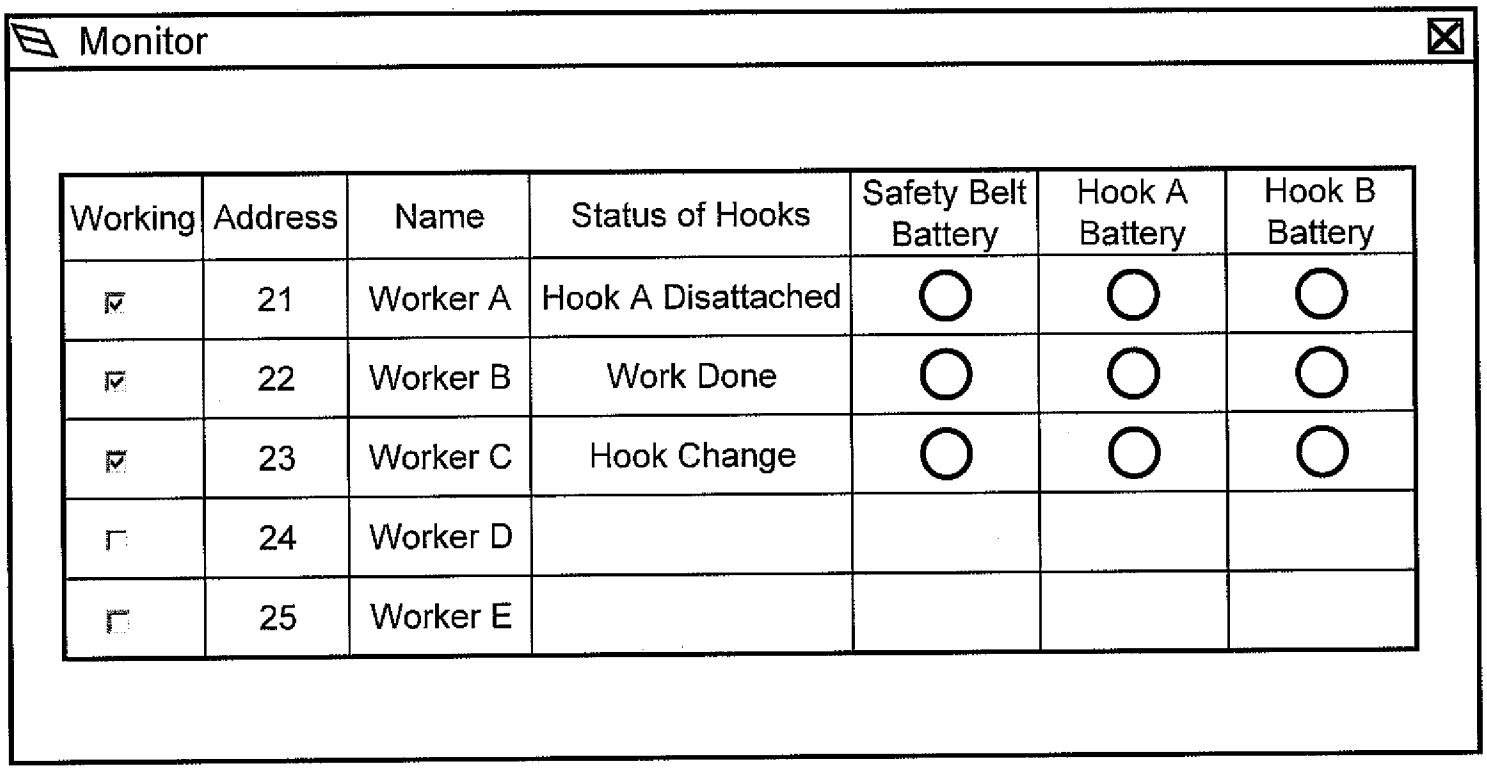
FIG. 10 shows an exemplary monitoring screen in the first preferred embodiment of the present invention.

For example, the monitoring screen of FIG. 10 shows the list of the workers. In the list, the name of every worker who is at work today has been input by an operator in advance. The operator also inputs the identification number (address) of the full-body harness type safety belt 1 used by each worker such that the identification number corresponds to the name of that worker. The control unit 210 of the control box 21 has the identification numbers of the safety belts 1 registered therein. When sending information to the PC 6 via the transmitter/receiver unit 211, the control unit 210 puts the identification number of the safety belt 1 associated with the information in the information. Thus, the PC 6 can match a plurality of pieces of information received from the transmitter/receiver units 211 of the safety belts 1 of a plurality of workers and the workers.

The monitoring screen of FIG. 10 shows battery statuses of the safety belt 1, the hook A (hook 72*a*), and the hook B (hook 72*b*). In the example of FIG. 10, white circle indicates that the battery is in a normal state. If the indication of the battery status is not white circle, the supervisor has to instruct the worker to change the battery.

The monitoring screen of FIG. 10 also shows the state of the hooks which is presented in accordance with the patterns shown in FIGS. 9A and 9B. In the example of FIG. 10, it is shown that the hook A of Worker A is out of the holding object. Thus, the supervisor needs to instruct Worker A to check the attaching sate of the hooks.

Although not shown in FIG. 10, it is preferable that the display manner be changed by controlling colors or blinking or not, depending on the state of the hooks, thereby making easier to recognize who is in a low-safety state. For example, the state "Hook A Disattached" may be displayed with red color, the state "Work Done" may be displayed with blue color, and the state "Hook Change" may be displayed with yellow color. In addition, the color of the display is preferably the same as or similar to the color of the light emitted from the LED light source 212 of the control box 21. This makes it easy to figure out the states and is convenient.

In addition to the display on the monitor 63, the PC 6 may output an audio notification from the speaker 65. When an audio notification of "The hook A of Worker A is Unattached" is provided, for example, the supervisor can check the attaching status of every worker more carefully and reliably.

As described above, according to this preferred embodiment, the worker, a person near the worker, and the supervisor who is far from the worker in the control room, for example, can clearly grasp the attaching state of the full-body harness type safety belt 1 and the lanyard 7 which are attached by the worker. Therefore, it is possible to make preparation to let workers properly attach the full-body harness type safety belts 1 and the lanyard 7 surely.

Figure 11:
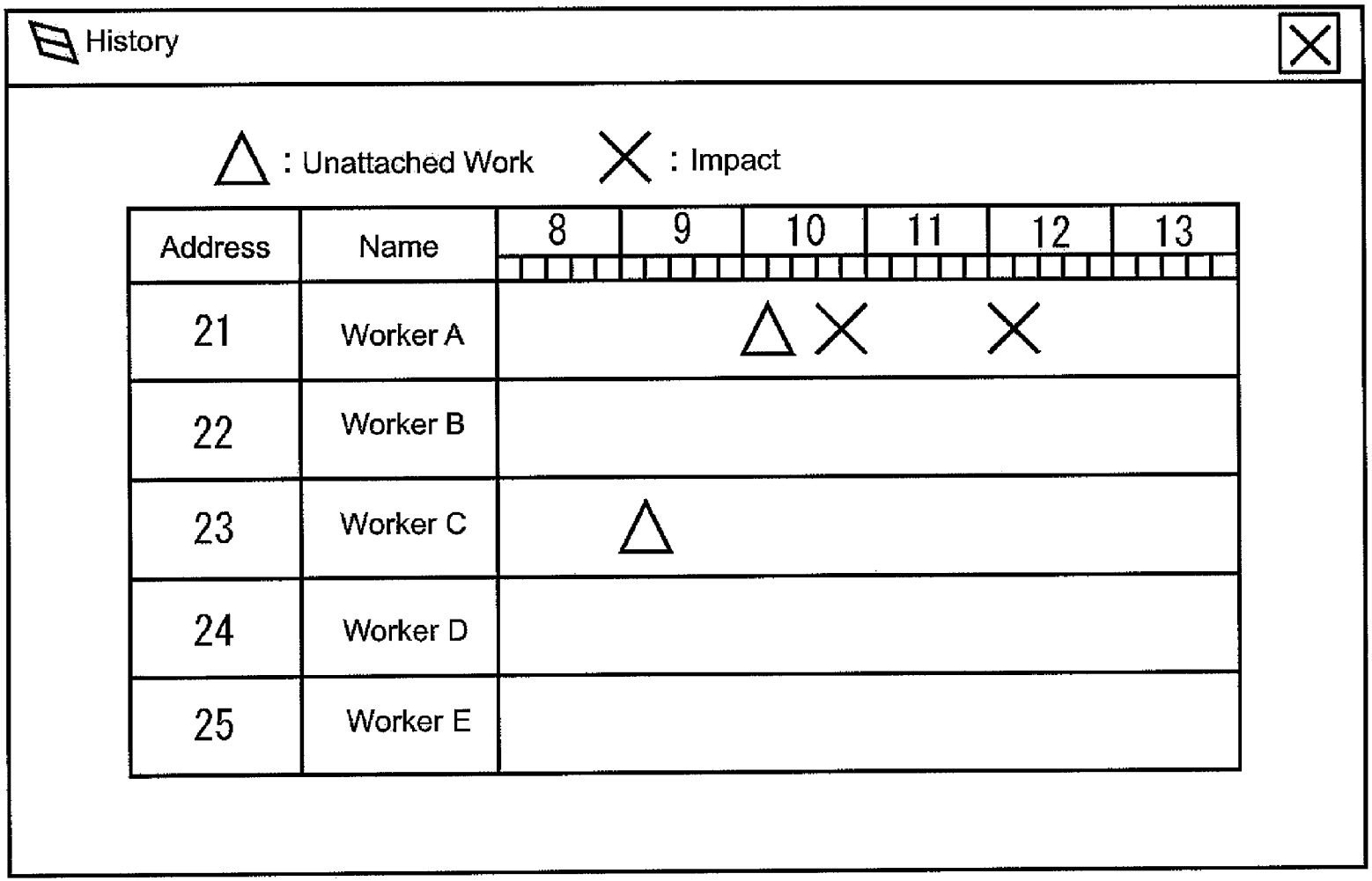
FIG. 11 shows an exemplary history screen in the first preferred embodiment of the present invention.

Based on the information received from the transmitter/receiver unit 211 of the control box 21, the control unit 61 of the PC 6 records the history thereof, creates a history screen for every worker, and displays the history screen on the monitor 63, as shown in FIG. 11. In the example of FIG. 11, each of the days in which workers were working (8th day to 13th day of a month in this example) is divided into a plurality of time zones (five zones in this example). When the worker was working without properly wearing or attaching the safety belt 1 or an impact was detected, symbol indicating "Unattached Work" or symbol indicating "Impact" is displayed for the corresponding time zone. For example, white triangle indicating "Unattached Work" on the screen of FIG. 11 shows the time zone in which the corresponding worker was working while the hook was not attached. Cross mark indicating "Impact" on the screen shows the time zone in which a fall of the corresponding worker on or from the scaffold was detected. Creating and displaying the history screen as described above enables the supervisor to easily recognize whether or not there is a worker who does not tend to properly use or attach the full-body harness type safety belt 1 and the lanyard 7. Moreover, it is also possible to monitor the frequency of falls and to take an adequate action for preventing falls.

It should be noted that the screens shown in FIGS. 10 and 11 are merely examples, but the preferred embodiments of the present invention is not limited thereto.

1-5. Modifications

In the above-described preferred embodiments, the wearing status or the attaching status of the full-body harness type safety belt 1 of each of a plurality of workers are checked preferably by the PC 6. That preferred embodiment is suitable for a case where there are many workers like in construction sites, a case where the control room is provided, and the like. In other cases, cell phones or portable devices, mobile devices such as PDA can be used instead of the PC 6.

In the above description, the example is described in which two lanyards are preferably connected to the full-body harness type safety belt 1. However, in another preferred embodiment of the present invention, only one lanyard can be used. Moreover, instead of the full-body harness type safety belt, a waist-belt type safety belt can be used.

In the above description, the pressure sensor 720 which detects the load in accordance with movement of the lever-shaped member 727 is described as an example of the sensor to detect a load applied to the hook 72. However, the sensor is not limited thereto. The following modifications can be considered.

Figure 12:
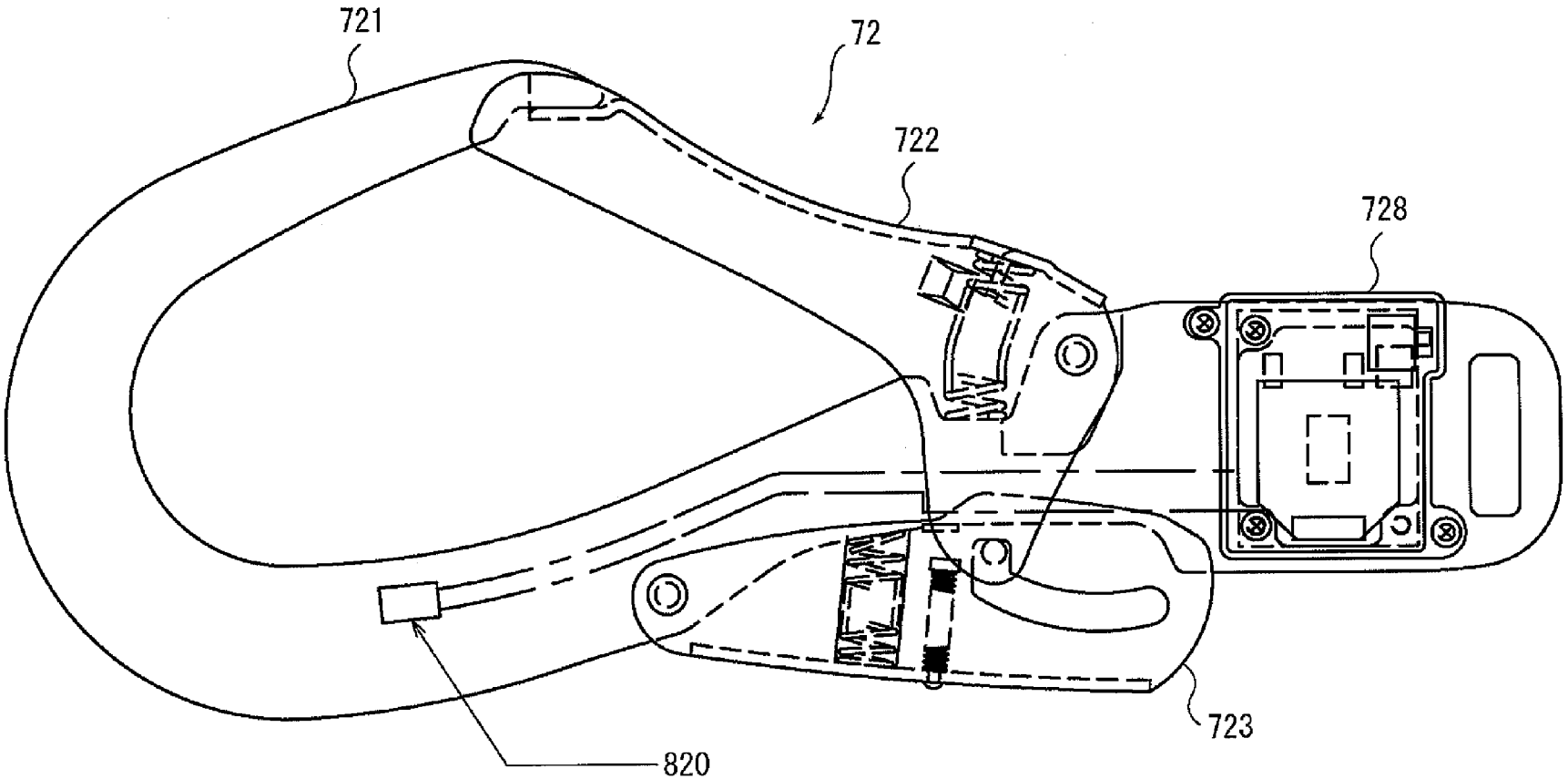
FIG. 12 shows an exemplary modification of the hook.

Instead of the lever-shaped member 727 and the pressure sensor 720, a strain gauge 820 may be included in the hook-shaped member 721, as shown in FIG. 12. In this arrangement, the strain gauge 820 can detect the amount of deformation of the hook-shaped member 721 caused by application of the load to the hook 72. The magnitude of the load applied to the hook 72 can be detected based on the detected deformation amount. In this case, it is preferable to provide an amplifier arranged to amplify the output of the strain gauge 820 in the circuit board 728.

Figure 13:
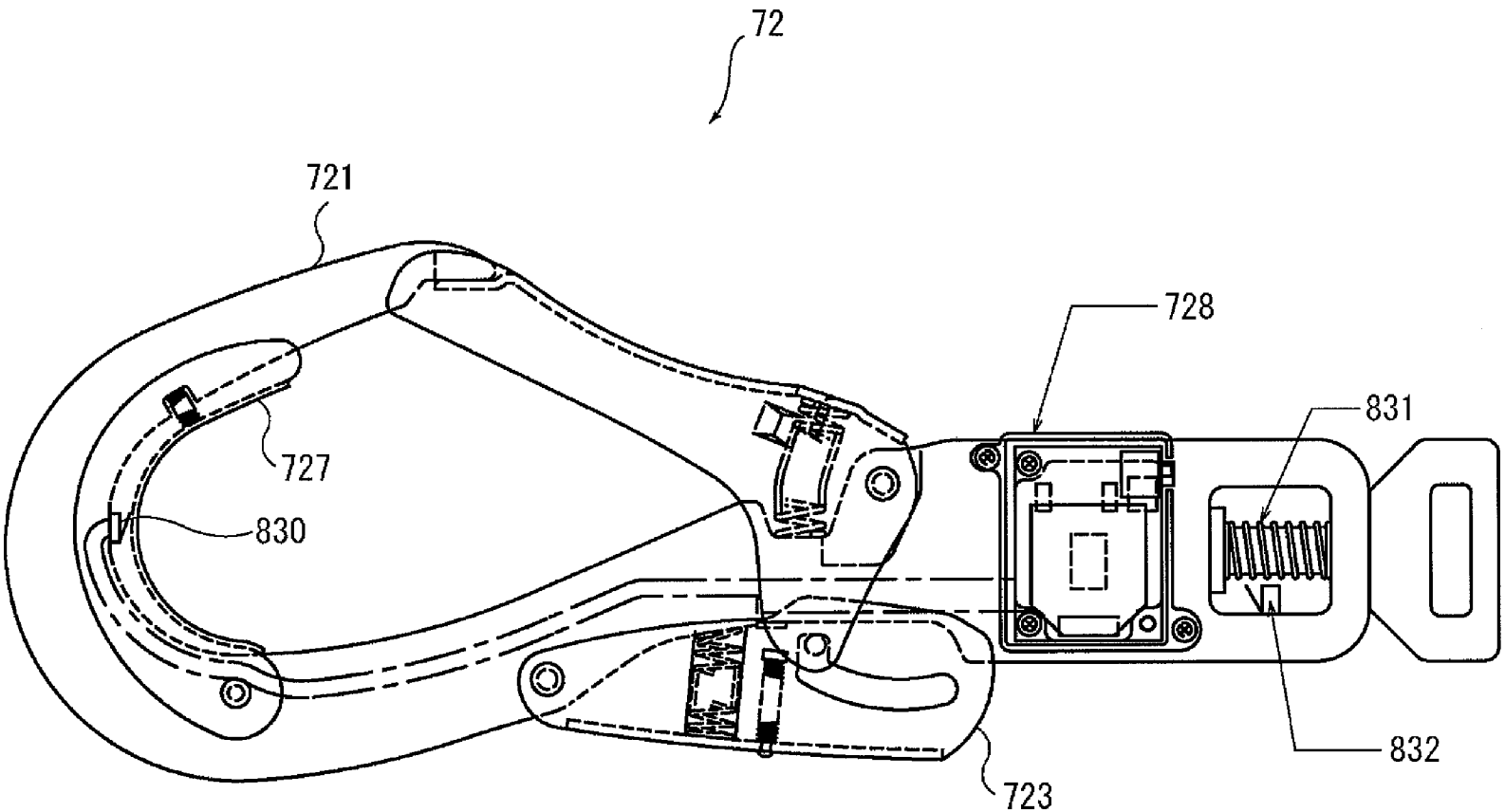
FIG. 13 shows another exemplary modification of the hook.

FIG. 13 shows another preferable arrangement. In this arrangement, a switch 830 (e.g., a Hall effect device) which is turned on when the lever-shaped member 727 is pushed is provided in the hook-shaped member 721, and a spring 831 and a switch 832 are provided at the portion at which the hook 72 and the lanyard 7 are connected to each other. The switch 830 detects that the hook 72 is attached to the holding object when detecting a load equal to or larger than a predetermined load (e.g., 2N). The switch 832 is turned on when detecting that the stretch amount of the spring 831 exceeds the stretch amount when a predetermined load (e.g., 300N) is applied. That is, the occurrence of a fall can be detected based on the output signal of the switch 832. The switch 832 is not limited to the above. A mechanical switch which can be set to be turned on and off can be used as the switch 832.

In the above description, the pressure sensor 720 detects a load (the unit of thereof is N) applied to the hook 72. Alternatively, the arrangement can be used in which a pressure (the unit thereof is Pa) applied to the hook 72 is detected.

Second Preferred Embodiment

The second preferred embodiment of the present invention is now described. In the following description, the same reference signs as those in the first preferred embodiment are used for the same or similar components as/to those in the first preferred embodiment, and the redundant description is omitted.

2-1. Structure of Safety Belt

Figure 14:
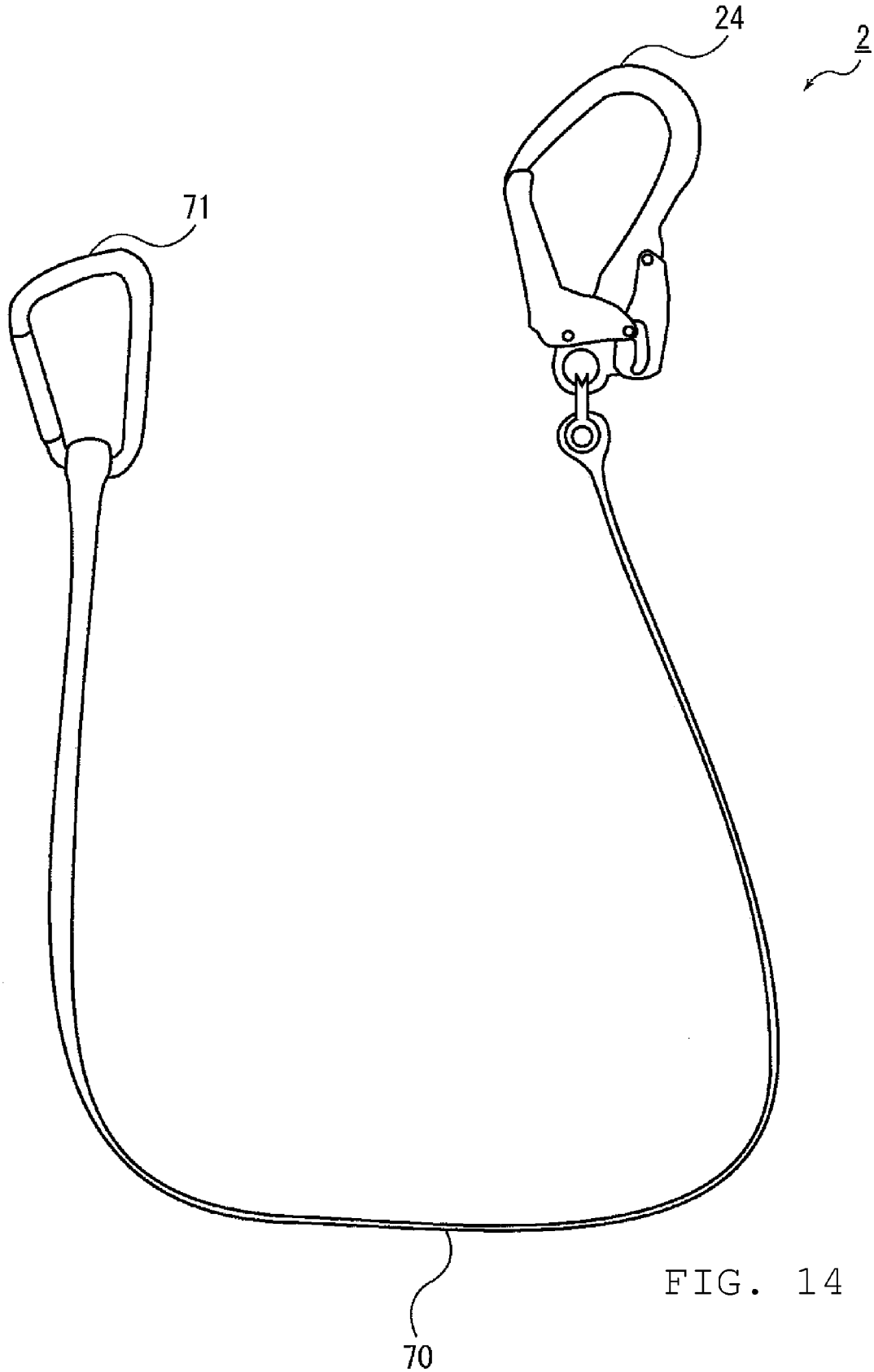
FIG. 14 shows the appearance of a safety belt according to the second preferred embodiment of the present invention.

FIG. 14 shows the appearance of a safety belt according to this preferred embodiment. As shown in FIG. 14, the safety belt of this preferred embodiment is a connecting member 2 in the form of a lanyard. The connecting member 2 includes a rope 70, a hook 24, and a carbine hook 71. The user who bought the connecting member 2 of this preferred embodiment uses it while attaching it to the user's body belt. Please note that the connecting member 2 can be attached to any of a full-body harness type and a waist-belt type. The connecting member 2 is used together with the control box 21 described in the first preferred embodiment. Thus, it is possible to sell the connecting member 2 and the control box 21 which are bundled, and the worker can use them by attaching them to the worker's body belt.

Figure 15:
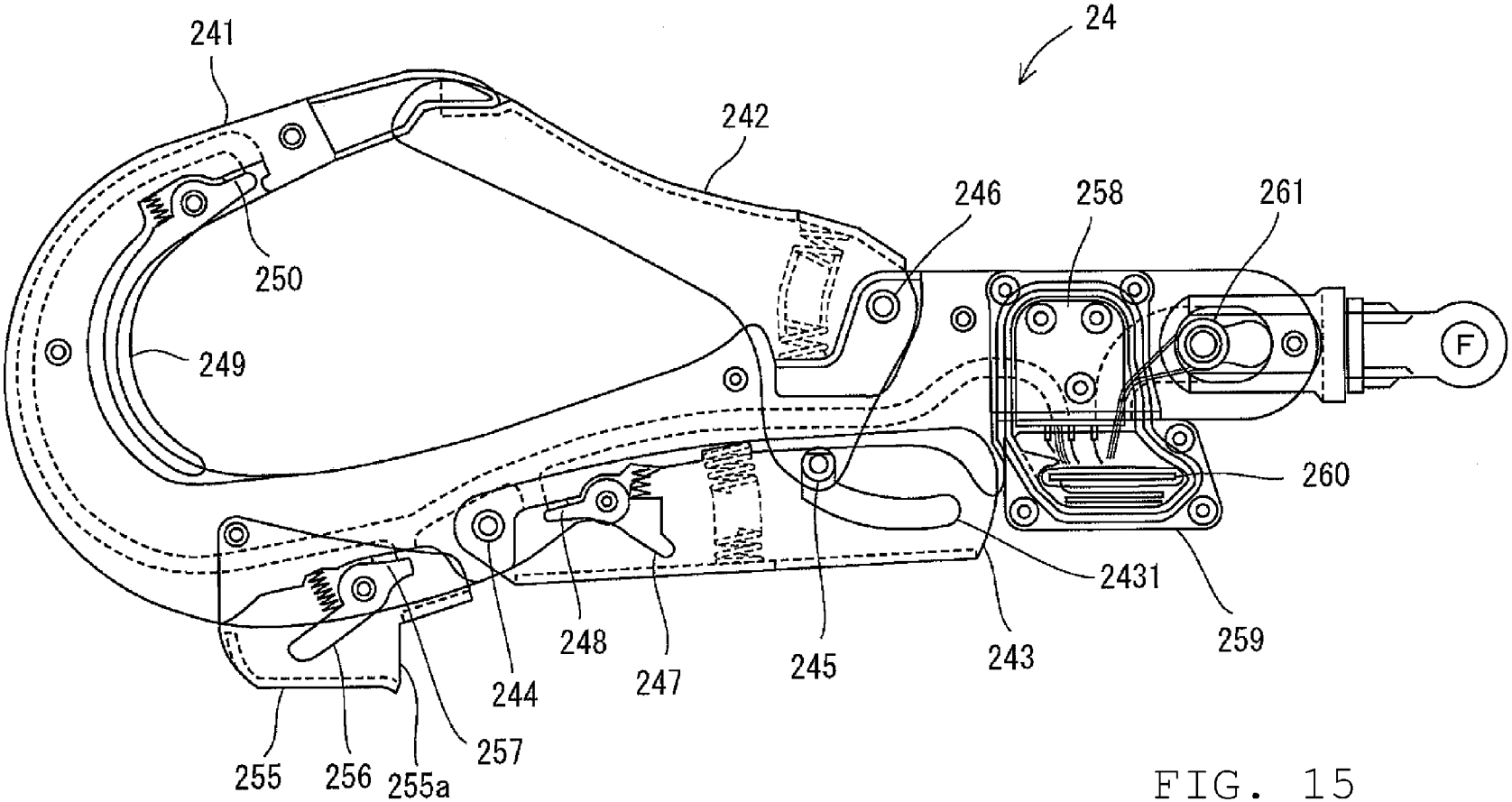
FIG. 15 shows the configuration of a hook in the second preferred embodiment of the present invention.

FIG. 15 shows the configuration of the hook 24. As shown in FIG. 15, the hook 24 includes a hook-shaped member 241, a latch 242, and a safety device 243. The latch 242 is arranged to be pivotally movable around a rivet 246 as an axis. The safety device 243 includes a slide groove 2431 and arranged to be pivotally movable about a rivet 244 as an axis. In the slide groove 2431 of the safety device 243, a rivet 245 attached to the latch 242 is located. The slide groove 2431 has a curved shape such that the rivet 245 slides in the slide groove 2431 when the worker grasps the safety device 243, and further slides in the slide groove 2431 when the worker grasps the latch 242 while grasping the safety device 243. In other words, the slide groove 2431 has a shape such that the latch 242 cannot be opened and closed even if an external force is applied to the latch 242 while the worker is not grasping the safety device 243.

The hook 24 also includes a lever 247 and a switch 248 in order to detect opening/closing of the latch 242. The lever 247 and the switch 248 are arranged such that, when the worker is grasping the safety device 243 and further grasps the latch 242, the lever 247 is pushed and moves away from the switch 248. Therefore, when the switch 248 is on, the latch 242 is closed. When the switch 248 is off, the latch 242 is opened.

This arrangement, in which the switch 248 is on when the latch 242 is closed, and is off when the latch 242 is opened, is more advantageous than the arrangement in which a pressure sensor detects that the latch 242 is opened, because it is not necessary to set a detection level and this arrangement has less malfunction.

The hook 24 further includes a lever 249 and a switch 250. The hook lever 249 is pushed when the hook 24 is attached to the holding object. The hook lever 249 is arranged to leave the switch 250 when being pushed. Therefore, when the switch 250 is on, the hook lever 249 is not pushed, that is, the hook 24 is not attached to the holding object. On the other hand, when the switch 250 is off, the lever 249 is pushed, that is, the hook 24 is attached to the holding object.

The arrangement of the switch 250, in which the switch 250 is on while the hook 24 is not attached to the holding object and is off while the hook 24 is attached to the holding object, is also advantageous in that setting of a detection level is not required and the malfunction of the switch 250 does not frequently occur. Moreover, malfunction of the switch 250 does not occur in a case where an impact is applied thereto while the hook 24 is attached and in a case where a load is applied at an angle. Also, no load is applied to the switch 250 when the hook 24 is attached. Therefore, durability of the switch 250 can be improved.

The hook 24 further includes a hook hanger housing 255 above the safety device 243. The hook hanger housing 255 is used when the hook 24 is attached to a hook hanger provided on the body belt. The hook hanger housing 255 has an opening **255*a* in its lower portion. The hook 24 can be attached to the hook hanger by putting the hook hanger of the body belt into the opening 255*a* of the hook hanger housing 255 such that the hook hanger housing 255** covers the hook hanger.

Inside the hook hanger housing 255, a lever 256 and a switch 257 are provided. The lever 256 is arranged to, when the hook hanger is put into the hook hanger housing 255, be pressed by the hook hanger and leave the switch 257. Therefore, when the switch 257 is on, the hook 24 is not attached to the hook hanger. When the switch 257 is off, the hook 24 is attached to the hook hanger.

At the base portion of the hook 24, a battery holder 258, an antenna 259, and a circuit board 260 are provided. The battery holder 258 accommodates a battery to supply a power to the antenna 259, the circuit board 260 and the like. The antenna 259 is used for transmitting data to and receiving data from the outside. At an end of the base portion of the hook 24, a disconnection sensor 261 is provided. The circuit board 260 receives and processes information on on/off of each of the switches 248, 250, and 257 and information on the sensing result of the disconnection sensor 261, and transmits the status of use of the connecting member 2 and the like to the outside via the antenna 259.

The disconnection sensor 261 is arranged such that, when a large load is applied due to a fall of the worker, for example, application of a tension caused by the load causes disconnection of a lead wire inside the disconnection sensor. Therefore, when disconnection occurs in the disconnection sensor 261, the circuit board 260 detects the disconnection and determines that the load corresponding to a fall is applied. In this preferred embodiment, the disconnection sensor 261 is provided at the end of the base portion of the hook 24. However, the position of the disconnection sensor 261 is not limited thereto. The disconnection sensor 261 can be arranged at any position of the hook 24, as long as the disconnection sensor 261 can be affected by the tension.

Figure 16:
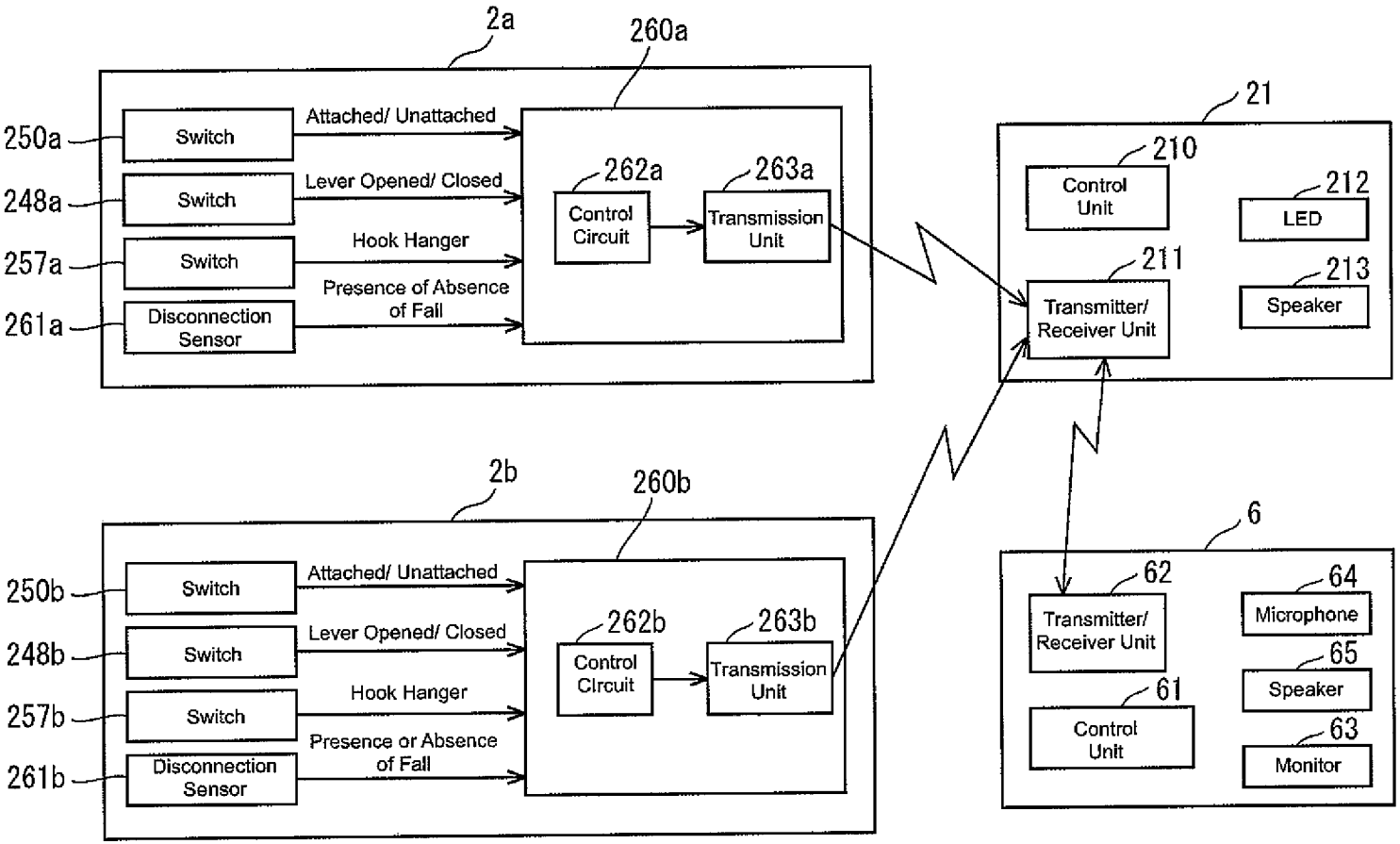
FIG. 16 is a block diagram showing the system configuration of a checking system according to the second preferred embodiment of the present invention.

2-2. Configuration and Operation of a System for Checking the Status of Usage of the Connecting Member Next, the configuration of a system for checking that the above connecting member 2 is properly used (hereinafter, simply referred to as a checking system) is described. FIG. 16 shows the system configuration of the checking system. The checking system includes the connecting member 2 and a personal computer (hereinafter, simply referred to as a PC) 6 as a central unit. In this description, it is assumed that two connecting members 2 are used while being attached to the body belt, and the two connecting members 2 are labeled with 2*a* and 2*b*. Similarly, "a" and "b" are added to the reference signs of the components of the connecting members 2*a* and 2*b*, if necessary. For example, the hook 24 of the connecting member 2*a* is referred to as "24*a*" and the hook 24 of the connecting member 2*b* is referred to as "24*b*".

The PC 6 is placed in a control room, for example. In a construction site, for example, the PC 6 is placed in a supervisor's office which is provided in the construction site. An application program to check the status of the connecting member is installed in the PC 6. The PC 6 can run an application to check the status of the connecting member by using the application program to check the status of the connecting member and a driver program such as a wireless LAN driver. That is, the checking system of this preferred embodiment is preferably defined by a commonly-used PC and programs.

As shown in FIG. 16, in the connecting member 2 of this preferred embodiment, information sent from the switches 250, 248, and 257 to the circuit board 260 is processed by a control circuit 262 provided on the circuit board 260. For example, the switch 250 outputs an ON signal when the hook 24 is not attached to the holding object and an OFF signal when the hook 24 is attached. The switch 248 outputs an ON/OFF signal indicating that the latch 242 is opened or closed. The switch 257 outputs an ON signal when the hook 24 is not accommodated in the hook hanger and an OFF signal when the hook 24 is accommodated in the hook hanger. The disconnection sensor 261 outputs a signal indicating whether or not a large load which is expected to be applied when the worker falls, for example, has been applied.

The control circuit 262 receives those signals and determines the status of the hooks 24 and the status of the worker. The determination result is transmitted from the transmission unit 263 provided in the circuit board 260 via the antenna 259. The transmitted data is received by the transmitter/receiver unit 211 of the control box 21.

The data received by the transmitter/receiver unit 211 of the control box 21 is sent to the control unit 210 of the control box 21 and is processed therein. In accordance with the contents of the received data, the control unit 210 drives the LED light source 212 and/or the speaker 213 to provide a notification, e.g., an instruction or warning to the worker, if needed. Also, the control unit 210 sends the data received from the connecting member 2 to the PC 6. The transmitter/receiver unit 62 of the PC 6 receives that data and performs the monitoring operation described in the first preferred embodiment. Although not shown in FIG. 16, a message indicating the worker's status and the like may be sent from the PC 6 to a portable device of the supervisor.

Next, examples of control are described which are performed in accordance with the status of the hooks 24*a* and 24*b*. The following examples are merely specific examples and can be modified in various ways if needed. The control is not limited to the following examples.

<a: Disconnection is Detected by the Disconnection Sensor 261.>

In either one of the hooks 24*a* and 24*b*, when the disconnection sensor 261 has output data indicating the occurrence of disconnection, this data may indicate the occurrence of a fall accident. Therefore, upon receiving this data, the control unit 210 of the control box 21 turns on the LED light source 212 and/or causes the speaker 213 to output a buzzer sound or warning tone. This enables other workers and the supervisor to recognize the fall accident early. The data is also sent to the PC 6, and the control unit 61 can display a screen for notifying occurrence of the fall accident on the monitor 63 and/or cause the speaker 65 to output a buzzer sound or warning tone.

<b: The Switch 257 is Turned Off.>

When the data indicating the switch 257 has been turned off is output, this means that the hook 24 is attached to the hook hanger of the body belt. If both the switch 257*a* of the hook 24*a* and the switch 257*b* of the hook 24*b* are not turned off after a predetermined time has elapsed after start of use of the connecting members 2 (e.g., the time when the power of the control box 21 is turned on), the control unit 210 of the control box 21 causes the speaker 213 to output a warning message, for example, thereby prompting the worker to properly attach the connecting members 2.

<c: The Switch 248 is Turned Off.>

When the data indicating that the switch 248 has been turned off is output, this means that the latch 242 is opened. If the switch 248 is not turned on after a predetermined time period has elapsed after the output of the data indicating that the switch 248 is turned off, the latch 242 may remain opened for some reasons (e.g., because the latch 242 is caught by the clothes of the worker). Therefore, the control unit 210 of the control box 21 causes the LED light source 212 light up and/or causes the speaker 213 output a buzzer sound or warning tone, thereby instructing the worker to check the latch 242.

<d: The Switch 250 is Turned Off.>

When the data indicating that the switch 250 has been turned off is output, this means that the hook 24 is attached to the holding object. For example, if the switch 250 of one of the hooks 24*a* and 24*b* is not turned off after a predetermined time period has elapsed after the switch 250 of that hook 24*a* or 24*b* is turned on (that is, that hook 24*a* or 24*b* is removed from the hook hanger), that hook 24*a* or 24*b* may not be properly attached to the holding object. Therefore, in this case, the control unit 210 of the control box 21 causes the LED light source 212 to light up and/or causes the speaker 213 to output a buzzer sound or warning tone, thereby instructing the worker to check the state of the hooks 24.

In some cases, the worker wearing two connecting members 2*a* and 2*b* works while always attaching those two connecting members to the holding object. In other cases, the worker attaches one connecting member (the connecting member 2*a* in this description) to the holding object during a normal work, and uses the other connecting member as the auxiliary connecting member when the worker moves from one place to another place on the scaffold, for example. That is, the connecting member 2*b* is used as the auxiliary connecting member while the worker removes the connecting member 2*a* from the holding object at the current place and attaches it to the holding object at the next place. In this manner, a state in which no connecting member is attached to any holding object is eliminated. Alternatively, while the connecting member 2*a* is attached to the holding object at the current place, the worker attaches the connecting member 2*b* to the holding object at the next place to which the worker moves, and then removes the connecting member 2*a* and moves.

In either of the above methods, when both the switch 250*a* of the hook 24*a* and the switch 250*b* of the hook 24*b* are turned on during work, none of the hooks is attached to the holding object. Therefore, in this case, the control unit 210 of the control box 21 makes the LED light source 212 light up and/or makes the speaker 213 output a buzzer sound or warning tone, thereby instructing the worker to check the state of the hooks 24.

2-3. Modifications of the Checking System

Other than the configuration shown in FIG. 16, the following system configurations can be applied.

Figure 17:
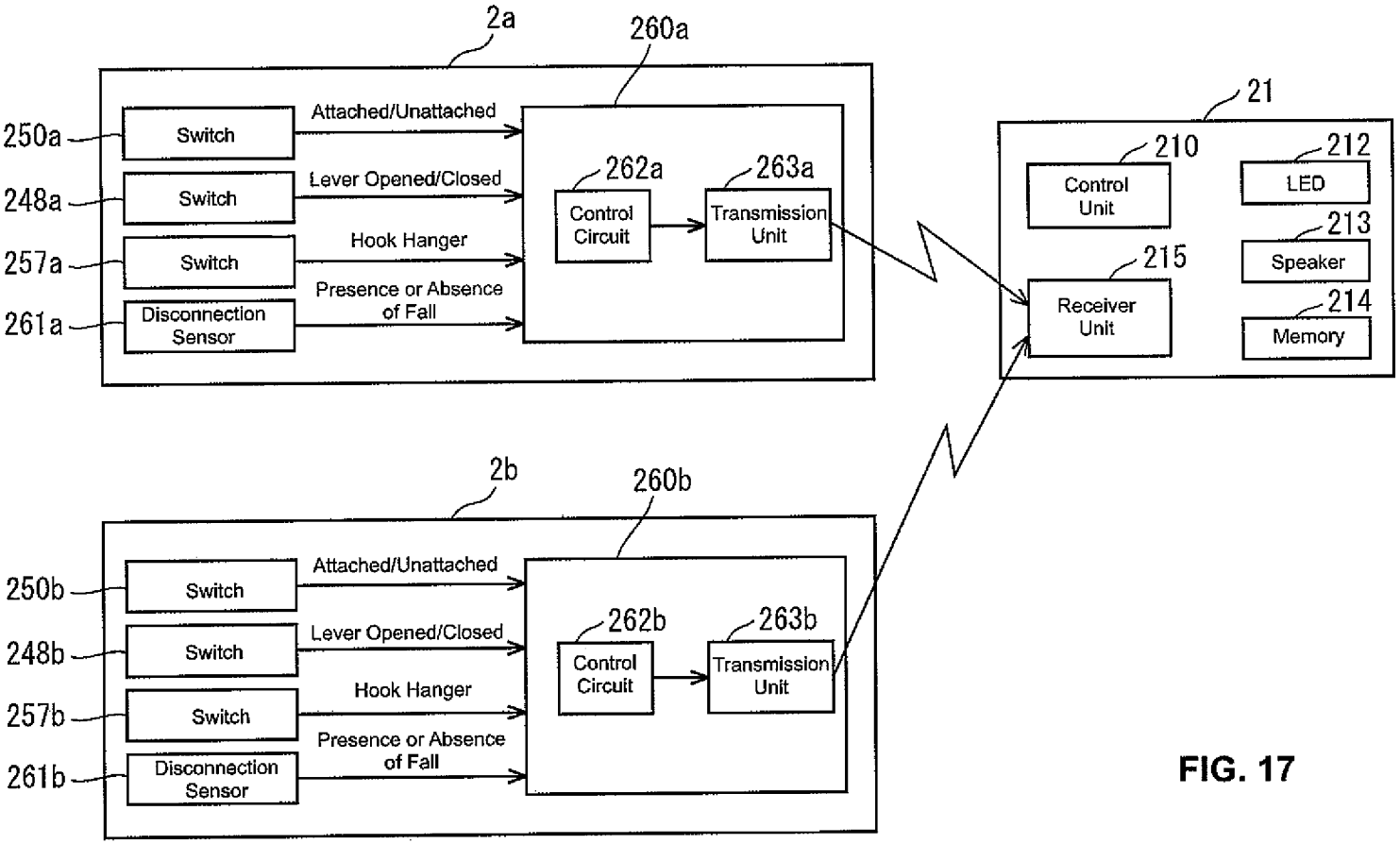
FIG. 17 is a block diagram of a modified example of the checking system in the second preferred embodiment of the present invention.

For example, the PC 6 as the central device can be omitted, as shown in FIG. 17. In this configuration, it is preferable that a memory 214 be further provided in the control box 21. The memory 214 stores data of the results of determination by the control circuits 262*a* and 262*b* based on the data from the switches 250*a* and 250*b* and the like. It is possible to analyze the attaching status of the connecting members 2*a* and 2*b* and the like by analyzing the data which is accumulated in and read from the memory 214, for example, after the day's work is done. Moreover, in this configuration, the transmitter/receiver unit 211 is replaced with a receiver unit 215 in the control box 21.

Figure 18:
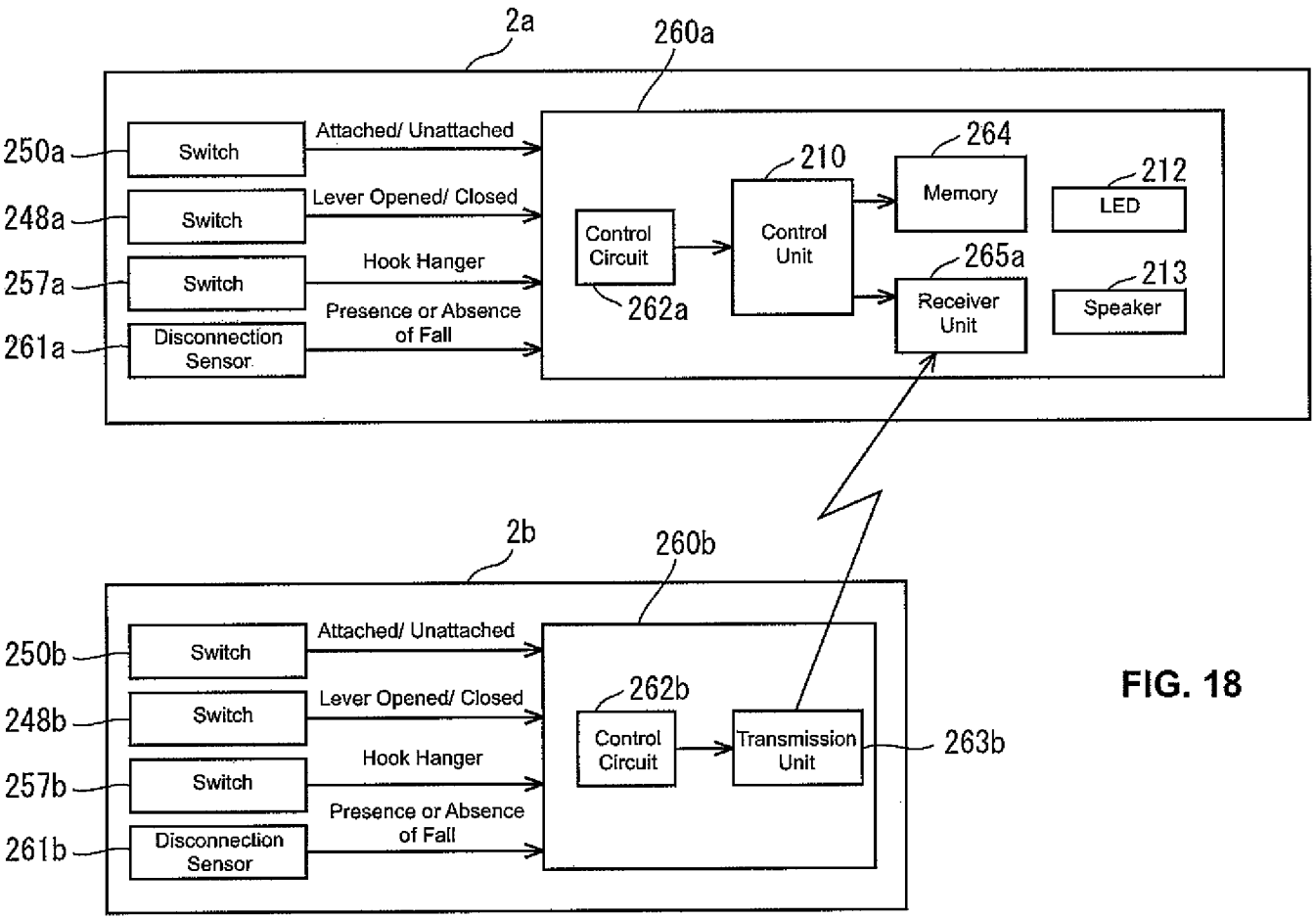
FIG. 18 is a block diagram of another modified example of the checking system in the second preferred embodiment of the present invention.

As shown in FIG. 18, the control box 21 can also be omitted. In the configuration of FIG. 18, the control unit 210, and the LED light source 212 and the speaker 213 if needed, are provided in the circuit board 260 of either of the connecting members 2*a* and 2*b*. In addition, a memory 264 is further provided in the configuration of FIG. 18. The memory 264 stores the data of the results of determination by the control unit 210 based on the data from the switches 250 and the like. It is possible to analyze the attaching status of the connecting members 2 and the like by analyzing the accumulated data read from the memory 264, for example, after the day's work is done. In the configuration of FIG. 18, a receiver unit 265*a* is provided in the circuit board 260*a*, which is arranged to receive data from the transmission unit 263*b* of the circuit board 260*b*.

Figure 19:
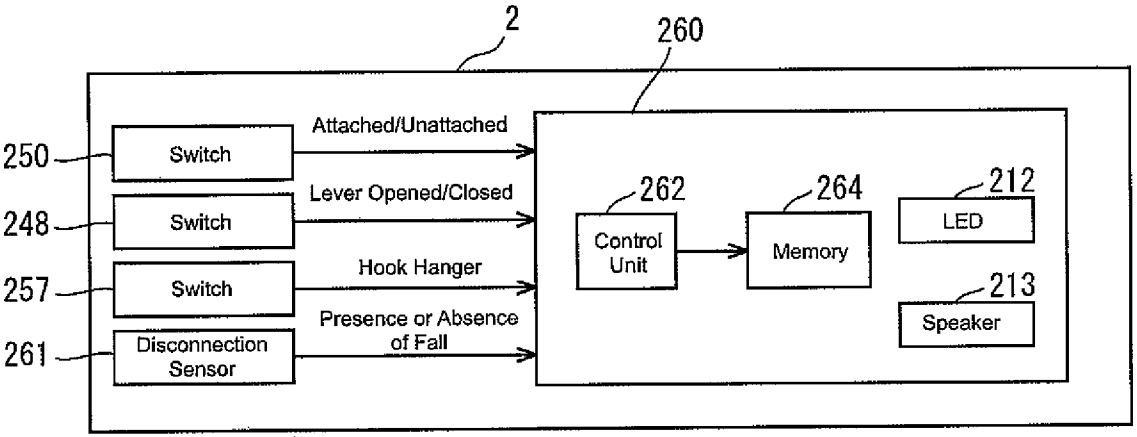
FIG. 19 is a block diagram of still another modified example of the checking system in the second preferred embodiment of the present invention.

As shown in FIG. 19, the configuration using only one connecting member 2 can be applied. In this case, the transmitter/receiver unit is not required. Also in the example of FIG. 19, the memory 264 is provided to store the data of the result of determination by the control circuit 262 based on the data from the switches 250 and the like. The LED light source 212 and the speaker 213 and the like may be added to the configuration of FIG. 19.

Third Preferred Embodiment

Still another preferred embodiment of the present invention is now described. The same or similar structure and configuration as/to that described in the aforementioned preferred embodiments are labeled with the same reference signs and the redundant description is omitted.

3-1. Configuration of Connecting Member

Figure 20:
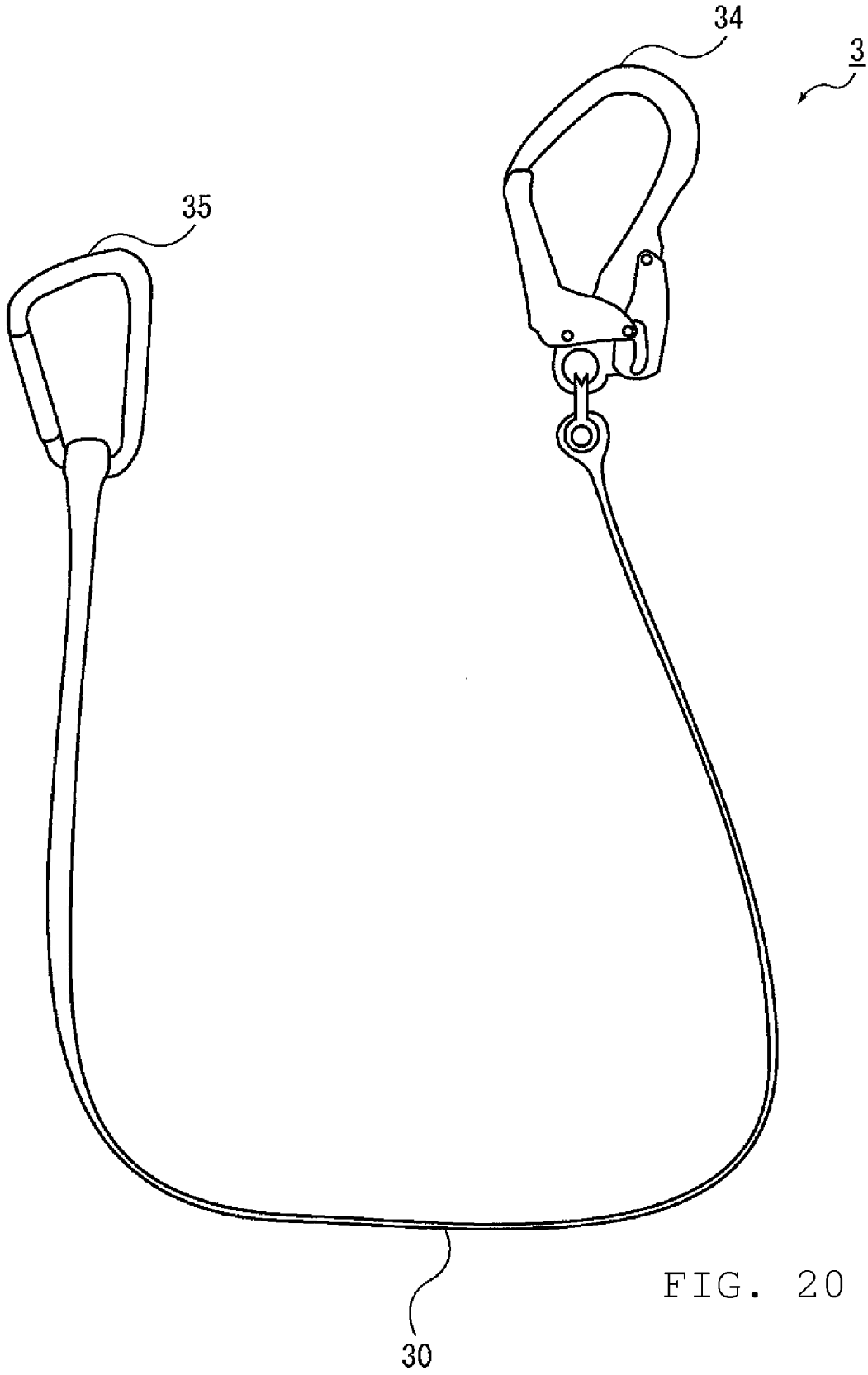
FIG. 20 shows the appearance of a safety belt according to the third preferred embodiment of the present invention.

A safety belt of this preferred embodiment is a connecting member 3 in the form of a lanyard. FIG. 20 shows the appearance of the connecting member 3 of this preferred embodiment. As shown in FIG. 20, the connecting member 3 includes a rope 30, a hook 34, and a carbine hook 35. The user who bought the connecting member 3 of this preferred embodiment uses it while attaching it to the user's body belt. As the body belt, both a full-body harness type and a waist-belt type can be used. The connecting member 3 is used together with the control box 21 of the first preferred embodiment. That is, it is possible to sell the connecting member 3 and the control box 21 which are bundled, and the worker can use them by attaching them to the worker's body belt.

The connecting member 3 of this preferred embodiment includes a disconnection sensor arranged to detect a fall of the worker in the rope 30, not in the hook 34. Therefore, the disconnection sensor 261 described in the second preferred embodiment can be omitted in the hook 34 of this preferred embodiment. Except for the disconnection sensor 261 not being provided, the hook 34 has the same configuration as the hook 24 of the second preferred embodiment. Therefore, the detailed description of the hook 34 is omitted.

3-2. Examples of Disconnection Sensor

Examples of the disconnection sensor provided in the rope 30 are described below.

Figure 21A:
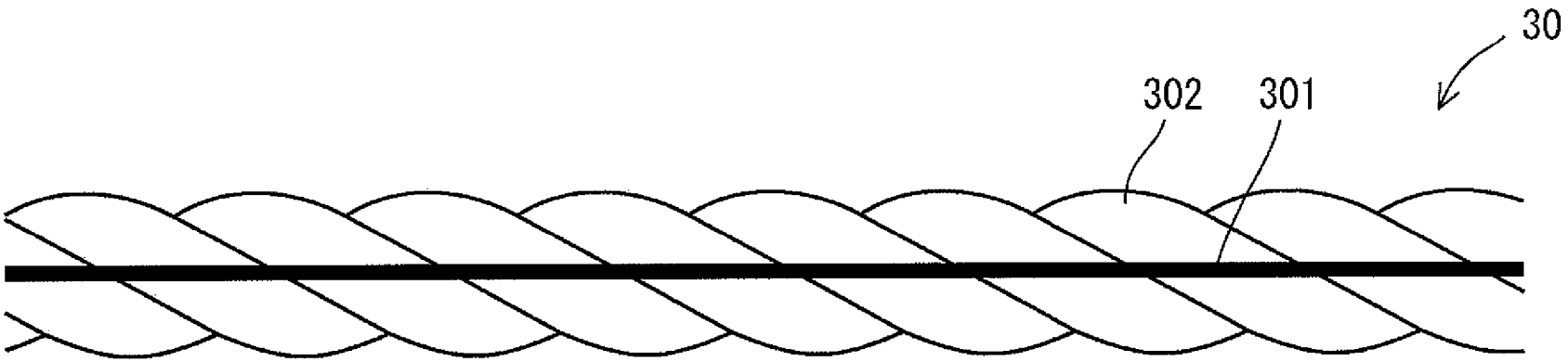
FIGS. 21A and 21B show a cross section of an exemplary connecting member in the third preferred embodiment of the present invention.
Figure 21B:
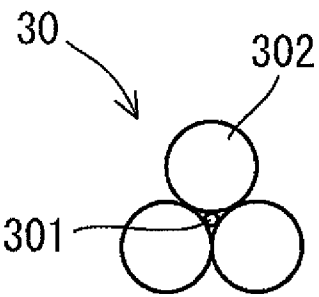

In the example shown in FIGS. 21A and 21B, a lead wire is included in the rope 30 as the core. FIG. 21B shows a cross section of the rope 30. The rope 30 is formed by winding resin fibers 302 around the lead wire 301. The resin fibers 302 can stretch to some extent when being pulled, but the lead wire 301 breaks when being pulled. Therefore, in a case where a large pulling force is applied due to a fall or the like, disconnection of the lead wire 301 occurs, thereby enabling the fall of the worker to be detected. The disconnection of the lead wire 301 can be detected by a circuit on the circuit board (which is the same as or similar to the circuit board 260 of the second preferred embodiment) provided in the hook 34, for example.

Figure 22:
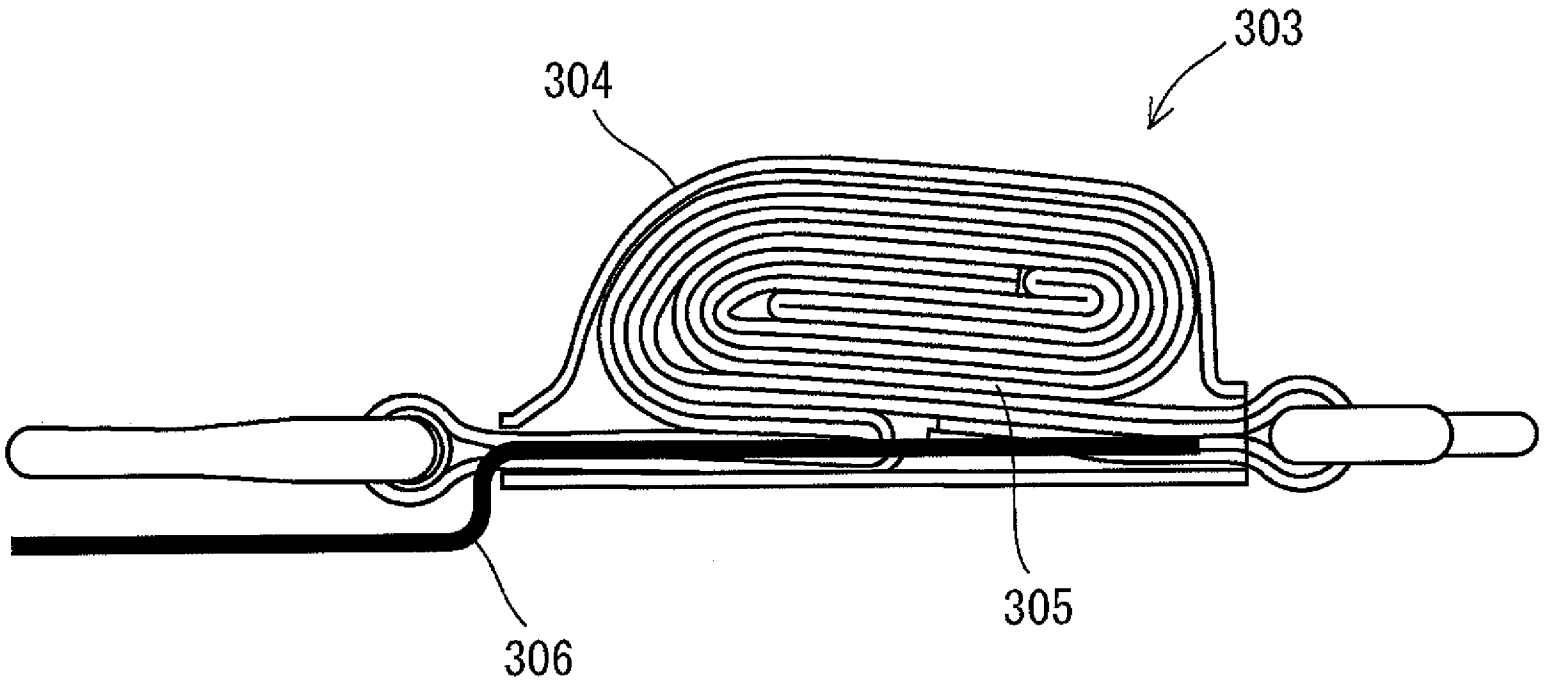
FIG. 22 shows a cross section of another exemplary connecting member in the third preferred embodiment of the present invention.

In the example of FIG. 22, a shock absorber 303 is provided at a middle portion of the rope 30. The position of the shock absorber 303 may be closer to the hook 34. However, it is preferable that the position of the shock absorber 303 be closer to the body of the worker (i.e., closer to the carbine hook 35), because a fall can be detected more precisely and reliably.

The shock absorber 303 includes a resin cover 304 and a belt 35 which is folded and accommodated inside the resin cover 304. When a large pulling force is applied to the rope 30, the resin cover 304 tears and the belt 305 extends. In this manner, an impact force applied to the rope 30 is absorbed. The belt 305 is preferably formed by resin fibers which can stretch to some extent. The shock absorber 303 includes a lead wire 306 therein. The length of the lead wire 306 is shorter than the length of the belt 305. Both ends of the belt 305 are connected to the lead wire 306. Thus, disconnection of the lead wire 306 occurs when the belt 305 extends and it is therefore possible to detect a fall of the worker. The disconnection of the lead wire 306 can be detected by a circuit on the circuit board (which is the same as or similar to the circuit board 260 of the second preferred embodiment) provided in the hook 34, for example.

3-3. Modifications of Disconnection Sensor

In the above examples, the disconnection sensors using the lead wire arranged to detect a fall of the worker are described. Other than the disconnection sensor, an acceleration sensor and a strain gauge (including a load cell) can be used for detecting a fall. Also, it is possible to detect a fall by providing a switch sensor such as a piezoelectric device, and the like in the rope 30 and the carbine hook 35.

As described above, according to the preferred embodiments of the present invention, the safety belt and the checking system to check the usage status of the safety belt can be provided, which make it possible to detect application of a large load, e.g., a load applied in a case of falling of the worker while the hook of the safety belt is attached to the holding object, and also make it possible to promptly rescue the fallen worker.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. A safety belt comprising:

a connecting member including a rope, an attaching portion connected to a first end of the rope and arranged to be attached to a body belt worn around a body of a worker, a hook connected to a second end of the rope, and a load detection portion arranged to detect whether or not a load is applied to the connecting member and to output a load detection signal; and a control device including a receiver unit arranged to receive the load detection signal, a control unit arranged to determine a status of the worker or a status of the safety belt based on the load detection signal, and a notification unit arranged to provide a notification in accordance with control performed by the control unit corresponding to the determined status.

2. A safety belt according to claim 1, wherein the hook of the connecting member includes a hook-shaped member, a latch arranged to be opened and closed with respect to an opening of the hook-shaped member, and a transmitter unit arranged to transmit the load detection signal, the load detection portion includes a pressure sensor provided at a position of the hook-shaped portion which comes into contact with a holding object when the hook is attached to the holding object, and the control unit is arranged to control the notification unit to provide a warning as the notification when detecting a load or a pressure exceeding a predetermined value for a time period longer than a predetermined time period from the load detection signal.

3. A safety belt according to claim 2, wherein the hook of the connecting member further includes an open/close sensor arranged to detect whether the latch is opened or closed and to output an open/close detection signal, and the control unit is arranged to control the notification unit to provide the notification that the connecting member is attached to the holding object, when the control unit detects from the open/close detection signal that the latch is opened and closed and detects from the load detection of the pressure sensor that a load or a pressure is equal to or smaller than the predetermined value.

4. A safety device according to claim 3, wherein the hook of the connecting member further includes an accommodation sensor arranged to detect that the hook is accommodated in a predetermined accommodating portion of the safety belt and to output an hook-accommodation detection signal, and the control unit is arranged to control the notification unit to provide the notification that the hook is out of the accommodation portion, when the control unit is unable to detect that the hook is accommodated in the accommodating portion from the hook-accommodation detection signal, and determines that the connecting member is not attached to the holding object.

5. A safety device according to claim 4, wherein, when the control unit detects from the open/close sensor that the latch is opened and closed while the connecting member is attached to the holding object, the control unit is arranged and programmed to control the notification unit to provide the notification that the connecting member is going to be detached from the holding object.

6. A safety device according to claim 4, wherein the safety device includes two connecting members, and when the control unit determines that only one of the two connecting members is attached to the holding object, the control unit is arranged and programmed to control the notification unit to provide the notification that the hook change is underway.

7. A safety device according to claim 1, wherein the notification unit includes a light-emitting portion arranged to emit light, and to provide the notification using light.

8. A safety device according to claim 1, wherein the notification unit includes an audio output portion arranged to provide an audio output as the notification.

9. A safety device according to claim 1, wherein the notification unit includes a transmitter unit arranged to wirelessly transmit the status of the worker or the status of the safety belt determined by the control unit, to a remote device located remotely from the worker.

10. A safety device according to claim 1, wherein the load detection portion includes a disconnection sensor provided in a base portion of the hook.

11. A safety device according to claim 1, wherein the load detection portion includes a disconnection sensor mounted in the connecting member.

12. A safety device according to claim 11, wherein the connecting member further includes a shock absorber including a lead wire therein, and the disconnection sensor is arranged to detect disconnection of the lead wire.

13. A system for checking a usage status of the safety belt as claimed in claim 1, further comprising a checking device arranged to wirelessly communicate with the control device of the safety belt, wherein the control device of the safety belt further includes a transmitter unit arranged to transmit to the checking device information on the status of the worker or the status of the safety belt determined by the control unit, and the checking device includes a monitor screen display unit arranged to display the status of the worker or the status of the safety belt based on the information received from the transmitter unit of the control unit.

14. A system for checking a usage status of a safety belt which includes a connecting member and a control device, wherein the connecting member includes a rope, an attaching portion connected to a first end of the rope and arranged to be attached to a body belt worn around a body of a worker, a hook connected to a second end of the rope, and a load detection portion arranged to detect whether or not a load is applied thereto, and the control device includes a receiver unit arranged to receive the load detection signal, a control unit arranged to determine a status of the worker or the safety belt from the load detection signal, a notification unit arranged to provide a notification in accordance with control performed by the control unit corresponding to the determined status of the worker or the safety belt, and a transmitter unit arranged to transmit information on the determined status, the system comprising a checking device arranged to wirelessly communicate with the control device of the safety belt, wherein the checking device includes a monitor screen display unit arranged to display the status of the worker or the status of the safety belt based on the information received from the transmitter unit of the control unit.

15. A system according to claim 14, wherein the hook of the connecting member of the safety belt includes a hook-shaped member, a latch arranged to be opened and closed with respect to an opening of the hook-shaped member, and a transmitter unit arranged to transmit the load detection signal of the load detection portion, and the load detection portion of the connecting member of the safety belt includes a pressure sensor arranged at a portion of the hook-shaped portion which comes into contact with a holding object when the hook is attached to the holding object.

16. A system according to claim 14, wherein the checking device further includes a history screen display unit arranged to display a history of the status of the worker or the status of the safety belt based on the information received from the transmitter of the control device.

17. A system according to claim 14, wherein the hook of the connecting member of the safety belt includes a hook-shaped member, a latch arranged to be opened and closed with respect to an opening of the hook-shaped member, and a transmitter unit arranged to transmit the load detection signal of the load detection portion, and the load detection portion of the connecting member of the safety belt includes a pressure sensor arranged at a portion of the hook-shaped portion which comes into contact with a holding object when the hook is attached to the holding object.

18. A system according to claim 14, wherein the checking device further includes a history screen display unit arranged to display a history of the status of the worker or the status of the safety belt based on the information received from the transmitter of the control device.

* * * * *